US005821700A

United States Patent [19]

Malvaso

[11] Patent Number: 5,821,700

[45] Date of Patent: Oct. 13, 1998

[54] VISUAL WARNING SYSTEM FOR A RAILWAY VEHICLE

[75] Inventor: John A. Malvaso, Victor, N.Y.

[73] Assignee: Star Headlight & Lantern Co., Avon, N.Y.

[21] Appl. No.: 771,717

[22] Filed: Dec. 20, 1996

[51] Int. Cl.[6] ..... G05F 1/00

[52] U.S. Cl. ..... 315/291; 315/307; 315/200 A; 315/82; 315/DIG. 4; 307/10.8; 340/463; 340/474

[58] Field of Search ..... 315/291, 307, 315/200 A, 209 R, 224, 77, 82, DIG. 4, DIG. 7; 307/10.1, 10.8; 340/463, 471, 474, 641

[56] References Cited

U.S. PATENT DOCUMENTS

| | | | |
|---|---|---|---|
| 2,567,425 | 9/1951 | Dillon | 177/311.5 |
| 3,113,293 | 12/1963 | Breese et al. | 340/50 |
| 3,891,986 | 6/1975 | Lipe et al. | 340/371 |
| 4,011,541 | 3/1977 | Fabry et al. | 340/25 |
| 4,108,405 | 8/1978 | Gibson | 246/125 |
| 4,114,071 | 9/1978 | Thrower, Jr. et al. | 315/226 |
| 4,213,115 | 7/1980 | Wetzel | 340/47 |
| 4,225,808 | 9/1980 | Saraceni | 315/307 |
| 4,325,007 | 4/1982 | Prohaska et al. | 315/200 A |
| 4,849,683 | 7/1989 | Flolid | 323/284 |
| 5,182,503 | 1/1993 | Denneman et al. | 315/224 |
| 5,262,701 | 11/1993 | Derra et al. | 315/224 |
| 5,268,616 | 12/1993 | Dean et al. | 315/77 |
| 5,287,040 | 2/1994 | Lestician | 315/291 |
| 5,315,214 | 5/1994 | Lesea | 315/209 R |
| 5,336,976 | 8/1994 | Webb et al. | 315/134 |
| 5,357,173 | 10/1994 | Kachmarik et al. | 315/209 R |
| 5,369,340 | 11/1994 | Leyten | 315/307 |
| 5,534,733 | 7/1996 | Wetzel et al. | 315/77 X |
| 5,646,453 | 7/1997 | Wetzel et al. | 307/10.1 |

*Primary Examiner*—Robert J. Pascal
*Assistant Examiner*—Haissa Philogene
*Attorney, Agent, or Firm*—M. LuKacher; K. LuKacher

[57] ABSTRACT

A visual warning system for a railway vehicle, particularly a locomotive, to illuminate the tracks or the right of way (sometimes called a ditch). The system has a first lamp and a second lamp. The first lamp is driven by a first lamp driver responsive to a first pulse width modulated signal, and the second lamp driver is driven by a second lamp driver responsive to a second pulse width modulated signal. A controller produces the first and second pulse width modulated signals in which the duty cycle of the first and second pulse width modulated signals is varied between high and low levels to alternatively turn the first and second lamps approximately fully on and approximately fully off. To turn each lamp approximately fully on, the controller increases, step-wise, the duty cycle of the lamp's respective pulse width modulated signal from the low level to the high level. The system may further include a switch for operating a horn on the vehicle. When this switch is not depressed, the controller maintains both the first and second pulse width modulated signals at either the low or high duty cycle level. When the horn switch is depressed, the controller varies the first and second pulse width modulated signals between the low and high duty cycle levels to alternatively turn the first and second lamps approximately fully on and off, and then after the horn switch is released, continues alternating the first and second lamps approximately fully on and off for a predefined period.

26 Claims, 13 Drawing Sheets

VISUAL WARNING SYSTEM FOR A RAILWAY VEHICLE

FIELD OF THE INVENTION

The present invention relates to a visual warning system (and method) for a railway vehicle, and relates particularly to a visual warning system (and method) for a railway vehicle having two lamps which alternatively flash when the horn on the locomotive is sounded and continue to flash for a period thereafter. This invention is useful for providing improved control of a pair of ditch lights mounted low on the front end of a locomotive.

BACKGROUND OF THE INVENTION

At railroad crossings pedestrians and vehicular traffic must be warned of approaching locomotives. In addition to the protective devices which may be present at railroad crossings, such as gates and flashing red lights, and audible signals from the locomotives' horn or whistle, visual signals on the locomotive are used to warn pedestrians and vehicular traffic. Typically, these visual signals are flashing lights controlled by an electronic system, such as shown in U.S. Pat. No. 3,113,293, issued to Breese, U.S. Pat. No. 3,891,986, issued to Lipe et al., and U.S. Pat. No. 4,213,115, issued to Wetzel. One particular type of warning lights for locomotives are called ditch lights. A pair of such so called ditch lights may be mounted low on the front end of a locomotive. These ditch lights alternatively flash when a horn is sounded by the locomotive operator to illuminate the ditch of the railroad track at railroad crossings. Systems for controlling such ditch lights are manufactured by the Quest Corporation, Brooklyn Heights, Ohio.

These electronic warning light systems typically use halogen lamps with tungsten filaments to provide a high visibility warning signal. The problem with such warning light systems is that these lamps have a short life, and thus require frequent replacement at substantial cost. One reason for their short life is that as these lamps turn on they draw a large amount of current, called inrush current, which is about ten times their normal operating current. The inrush current is due to the response of the tungsten filament in the lamp to applied current. This filament has an extremely low resistance when at non-operating temperatures, but as current is applied, the filament warms and its resistance increases until the lamp's normal operating temperature is reached, which takes about 100 to 200 milliseconds. During this period, the rapid change in filament temperature causes a rapid expansion of the filament, and as a result, mechanical stress is produced in the area of the filament which fastens to a holder mechanism within the lamp. This stress is applied to the filament each time the lamp turns on during flashing, and can cause the filament to fail, thereby greatly shortening the life of the lamp.

Other electronic systems have been proposed to control the current or voltage to lamps using pulse width modulation in non-locomotive applications. For example, U.S. Pat. No. 5,336,976, issued to Webb et al., describes a document scanner having a control system using pulse width modulation to control lamp intensity during warm-up of the scanner lamp. U.S. Pat. No. 5,268,616, issued to Dean et al., describes a system for dimming vehicle instrument panel lamps using pulse width modulation. U.S. Pat. No. 5,262,701, issued to Derra et al., describes a dimming circuit for a high pressure sodium lamp using pulse width modulation to control color temperature of the lamp. U.S. Pat. No. 5,287,040, issued to Lestician, describes an electronic ballast device using pulse width modulation for controlling the power to a gas discharge lamp, such as a florescent light.

The system of the invention has an important feature for control of the current to flash a lamp using pulse width modulation, whereby the lamp's inrush current is reduced and lamp life is increased.

SUMMARY OF THE INVENTION

Accordingly, a principal object of the present invention is to provide an improved visual warning system and method for a railway vehicle having two lamps which project light ahead of the vehicle and in which pulse width modulated signals, with controllable duty cycles, are applied to the drivers of the lamps to reduce the inrush current to the lamps when they turn on, thereby increasing the life of the lamps as compared with known visual warning systems for railway vehicles.

Another object of the present invention is to provide an improved visual warning system and method for a railway vehicle having a lamp or lamps, which can function as a ditch light, and which in the case of two lamps are used, alternatively flash responsive to the sounding of the horn on the vehicle and flash for a period thereafter, and in which the filaments of the lamps between flashes are maintained preheated and the voltage to the lamp or lamps increase step-wise when turning from off to on.

Another object of the present invention is to provide an improved visual warning system and method for a railway vehicle having a warning lamp or lamps driven by lamp drivers which are protected from damage, especially if the lamp becomes shorted.

A further object of the present invention is to provide an improved visual warning system and method for a railway vehicle having two lamps which senses when either lamp is open or shorted, and then automatically attempts recovery of the open or shorted lamp, unless the temperature of the driver for the lamps exceeds a predefined threshold.

A still further object of the present invention is to provide an improved visual warning system and method for a railway vehicle having two lamps in which their lamp drivers are independent of each other, such that if only one lamp is open or shorted, the other lamp continues to function.

A yet still further object of the present invention is to provide an improved visual warning system and method for a railway vehicle which accommodates for lamps operating at either standard railway operating voltages (74 volts or 32 volts).

Briefly described, an improved visual warning system for a railway vehicle in accordance with the invention embodies a first lamp and a second lamp. The first lamp is driven by a first lamp driver responsive to a first pulse width modulated signal, and the second lamp driver is driven by a second lamp driver responsive to a second pulse width modulated signal. A controller is provided for producing the first and second pulse width modulated signals in which the duty cycle of the first and second pulse width modulated signals is varied between high and low levels to alternatively turn the first and second lamps approximately fully on and approximately fully off.

To turn approximately fully on the first lamp, the controller operates in accordance with the method of the invention to increase step-wise the duty cycle of the first pulse width modulated signal from the low level to the high level, and to turn approximately fully on the second lamp increases step-wise the duty cycle of the second pulse width modulated signal from the low level to the high level.

The system may further include a switch for operating a horn which produces an audible signal from the vehicle. When this switch is not depressed, the controller maintains both the first and second pulse width modulated signals at either the low or high duty cycle level. When the horn switch is depressed, the controller varies the first and second pulse width modulated signals between the low and high duty cycle levels to alternatively turn the first and second lamps approximately fully on and off, and then after the horn switch is released, continues alternating the first and second lamps approximately fully on and off for a predefined period.

The lamp drivers also sense when their respective lamp is open or shorted. The controller in response to an open or shorted lamp attempts automatic recovery of the lamp after a predefined time interval, unless a temperature sensor in the system senses that the temperature of the lamp drivers has exceeded a predefined temperature threshold. Further, the lamp drivers, responsive to the controller, provide for preheating their respective lamp.

BRIEF DESCRIPTION OF THE DRAWINGS

The foregoing objects, features and advantages of the invention will become more apparent from a reading of the following description in connection with the accompanying drawings, in which.

DETAILED DESCRIPTION OF THE INVENTION

Figure 1:
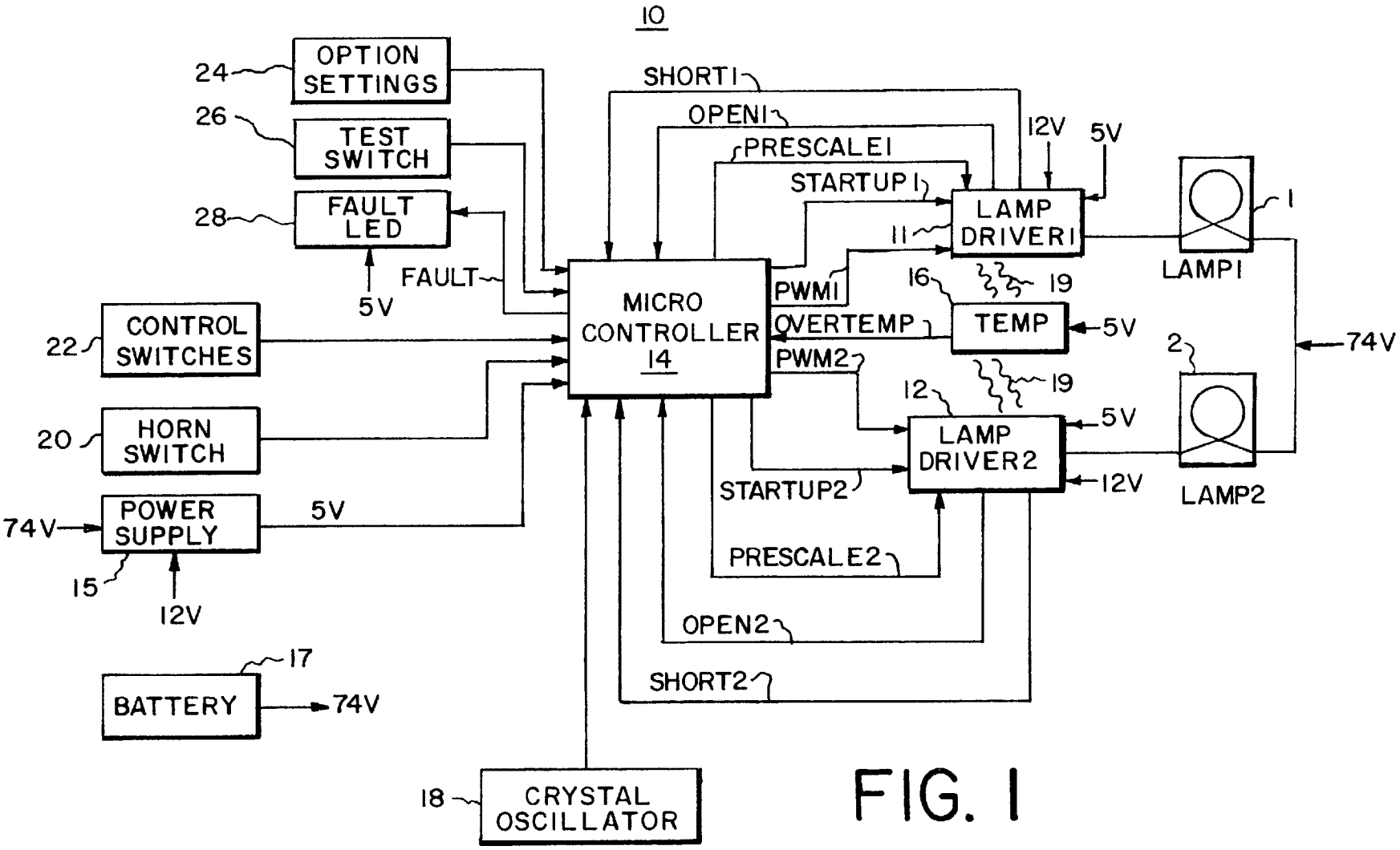
FIG. 1 is a block diagram of a system in accordance with the present invention.

Referring to FIG. 1, system 10 of the present invention is shown having a microcontroller 14 which controls the operation of the system in accordance with programmed instructions stored in memory of the microcontroller. Microcontroller 14 is a typical microprocessor integrated circuit (IC) chip, and may be, for example, a model 16C55 Microcontroller manufactured by Microchip Technology, Inc. of Chandler, Ariz. Microcontroller 14 receives a 5 V supply voltage from a power supply 15, which converts 74 V from a power source, such as a battery 17, to provide both 5 V and 12 V supply voltages for components in system 10. Power supply 15 may be a circuit having two voltage converter stages, each stage using a solid state voltage converter device, such as a LM317 IC chip to provide a 12 V output, and a LM2940T-5 IC chip to provide a 5 V output. However, other types of power supplies may be used, and the particular power supply is not critical to the present invention.

Microcontroller 14 controls the operation of lamps 1 and 2 via lamp drivers 11 and 12, respectively. Lamps 1 and 2 are powered by 74 V from battery 17, and are preferably high intensity lamps, such as halogen lamps with tungsten filaments. Lamps 1 and 2 operate at standard railway operating voltages of either 74 V or 32 V. Lamps 1 and 2 may represent a pair of ditch lights mounted on the lower front end of a railway vehicle, typically a locomotive, for illuminating the ditch of railroad tracks.

Lamp drivers 11 and 12 each receive a pulse width modulated voltage signal, PWM1 and PWM2, respectively, produced by microcontroller 14. PWM1 and PWM2 signals operate lamp drivers 11 and 12, respectively, to control the current flowing through lamps 1 and 2, respectively. Lamp drivers 11 and 12 will later be described in further detail in connection with FIGS. 3A and 3B. The PWM1 and PWM2 signals are each a 400 Hz square wave signal having a 2.5 millisecond period, with a variable duty cycle controllable by microcontroller 14. To control the duty cycle of each of the PWM1 and PWM2 signals, microcontroller 14 examines the period of each signal in 50 equal divisions. Each division represents a 50 microsecond interval in the 2.5 millisecond period. The duty cycle for the PWM1 and PWM2 signals are each based upon the number of consecutive divisions, extending from the first division in which the signal is high (active or logical 1) and then to the remaining divisions in the period in which the signal is low (non-active or logical 0). The length of time for the number of divisions which are high divided by the total period defines the duty cycle of the signal when multiplied by 100.

Figure 2A:
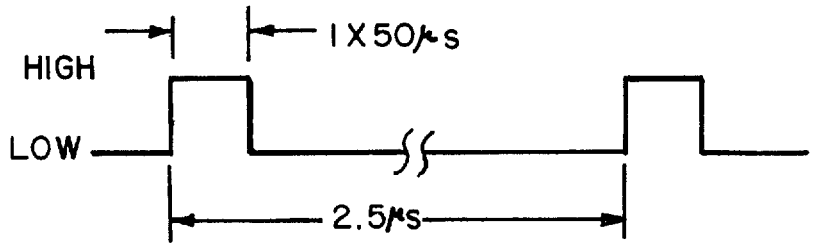
FIGS. 2A, 2B, and 2C are examples of timing diagrams showing the waveforms of the pulse width modulated signals (PWM1 or PWM2) with different duty cycles, such waveforms occurring in operation of the system of FIG. 1.
Figure 2B:
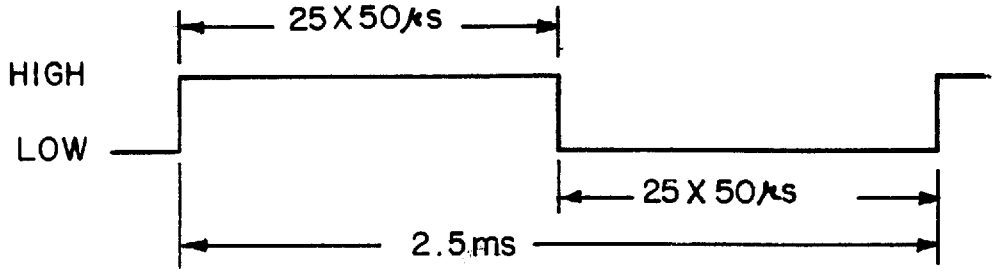
Figure 2C:
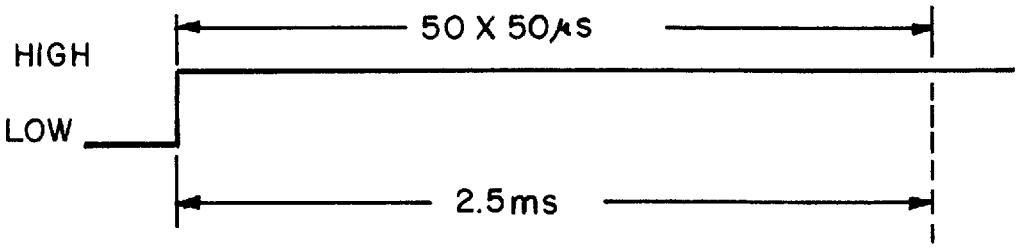

Examples of the PWM1 or PWM2 signal waveforms are shown in FIGS. 2A–C for different duty cycles. FIG. 2A shows the signal with only one high division in a period, and hence a 2% duty cycle (50 $\mu$S/2.5 mS). FIG. 2B shows the signal with twenty-five high divisions in a period, and hence a 50% duty cycle. FIG. 2C shows the signal with fifty high divisions in a period, and thus a 100% duty cycle. As will be shown later, the duty cycle of the PWM1 and PWM2 signals controls the current through, the effective voltage, and the intensity of lamps 1 and 2, respectively.

When the microcontroller 14 alternates the duty cycle of the PWM1 and PWM2 signal between high and low levels, the intensity of the lamps alternate between bright and idle (or off), thus alternately flashing lamps 1 and 2. The low duty cycle level is preferably about 2%, which maintains the lamp in a non-bright condition, such as a small glow of the lamp's filament. The high duty cycle level is based on the operating voltage of the lamps 1 and 2, and may be, for example, between about 15% (for a 32 V operating lamp) to about 100% (for a 74 V operating lamp).

To minimize inrush current when lamps 1 and 2 are each turned on, the lamps are keep preheated when off by microcontroller 14 maintaining the low duty cycle level (i.e., 2%) of the PWM1 or PWM2 signals, respectively. Thus, the lamps in an off state are approximately fully off. To further minimize inrush current, when lamps 1 and 2 are each turned from off to on, the duty cycle of the PWM1 and PWM2 signals, respectively, ramp up by increasing step-wise the duty cycle from its low level to its high level. Preferably, the ramp up takes 100 to 200 milliseconds (mS), and the step size is about 10%.

Figure 2D:
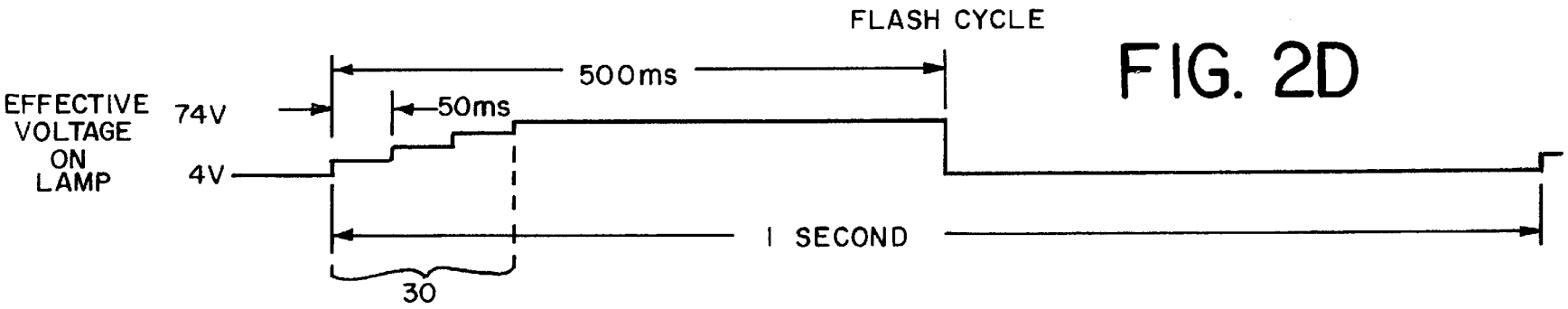
FIG. 2D is an illustration of the effective voltage on the lamps of FIG. 1 responsive to either the PWM1 or PWM2 signals.

The ramp up of a lamp is shown in FIG. 2D in terms of the effective voltage of a 74 V operating lamp being turned on during a 500 mS flash cycle. The effective voltage being the integration by the lamp of its actual applied voltage during successive cycles of the PWM1 or PWM2 signal for the same duty cycle. The duty cycle in this example increases in three steps. In step one, the duty cycle increases from 2% (off lamp state) to 25%, thereby providing an effective lamp voltage of 37 V. In step two, the duty cycle increase from 25% to 50%, providing an effective lamp voltage of 52.3 V. In step three, the duty cycle increases from 50% to 75%, providing an effective lamp voltage of 64.1 V. After step three, the duty cycle increases to 100% (on lamp state). Each step may be 50 milliseconds in duration, thus a ramp up (labelled 30) takes 150 millisecond from approximately fully off to approximately fully on. For a 32 V operating lamp, its effective voltage ramps to 32 V and thus the ramp up extends from 2% to 15% duty cycle.

In system 10, microcontroller 14 receives a low SHORT1 signal from lamp driver 11 if lamp 1 has shorted, indicating that a short fault condition has occurred, such as caused by a broken lamp. Microcontroller 14 also receives a high OPEN1 signal from lamp driver 11 if lamp 1 is open, indicating that an open fault condition has occurred, such as caused by a broken filament, or blown or missing lamp. Similarly, microcontroller 14 receives low SHORT2 and high OPEN2 signals from lamp driver 12, indicating if lamp 2 is in a shorted or open condition, respectively.

To further control the operation of lamp drivers 11 and 12, microcontroller 14 sends PRESCALE1 and STARTUP1 signals to lamp driver 11, and PRESCALE2 and STARTUP2 signals to lamp driver 12. The function of these signals will be described later in connection with FIGS. 3A and 3B.

System 10 further includes an over-temperature sensing unit 16 (TEMP) which is mechanically coupled to the lamp drivers 11 and 12 to sense their temperature (as indicated by wavy lines). The unit provides an active OVERTEMP signal (i.e., low) to microcontroller 14 if the temperature of drivers 11 and 12 exceeds a predefined temperature threshold. For example, this temperature threshold may be in the range of about 130 to about 150 degrees Celsius. The active OVERTEMP signal is debounced by the microcontroller. (The term "debounced" as used herein refers to the microcontroller checking if the level of the signal from a switch or unit is constant, or on average the same, for a certain period of time to determine that a valid signal is present.) Unit 16 will be described in further detail in connection with FIG. 4.

Also, system 10 has a fault indicator 28, such as a light emitting diode (led), which is turned on by a FAULT signal from microcontroller 14 when the microcontroller receives either a SHORT1, OPEN1, SHORT2, OPEN2, or OVERTEMP signal. Optionally, a separate led corresponding to different FAULT signals may be used to indicate each one of the SHORT1, OPEN1, SHORT2, OPEN2, or OVERTEMP signals being received by the microcontroller, or combinations of such signals. The fault indicator may be mounted in a location visible to the operator of the railway vehicle to indicate when a fault in system 10 has occurred.

In addition, microcontroller 14 also receives a 20 MHz reference signal from a crystal oscillator 18. This reference signal is used by the microcontroller to control the operation of different software timers used by the program in the microcontroller to control the operation of system 10. These timers will be defined during the discussion of the program in connection with FIGS. 5, and 6A–6G.

System 10 further includes a horn switch 20 which controls the operation of a horn, whistle, bell, or other similar audible signalling device. When horn switch 20 is depressed, the switch sends an active signal to the microcontroller 14 indicating that the horn has been activated. The microcontroller, in response to the horn activation, flashes alternatively lamps 1 and 2, and will continue to flash the lamps for a period thereafter, such as 30 seconds. System 10 also has a test switch 26 which when depressed sends an active signal to the microcontroller. The microcontroller responsive to an active signal from test switch 26, functions the same as an active signal from horn switch 20, but no audible signal is produced. An active signal from either the horn or test switches may, for example, represent a high signal, whereas when not depressed the signal from each switch is not active or low. Horn switch 20 and test switch 26 are each a spring release button which may be pressed by the operator of the railway vehicle, and are debounced by the microcontroller. Optionally, horn switch 20 may be a air pressure switch activating a horn.

To allow an operator to set operational parameters of system 10, control switches 22 and option settings 24 are provided. Control switches 22 may be dip switches, such that when each of the dip switches is closed a signal from the closed switch is sent to microcontroller 14. Preferably, there are at least four control switches 22: a first control switch to select the length the lamps will flash after horn switch 20 or test switch 26 is depressed; a second control switch to select the operating voltage for lamps 1 and 2 as 74 V or 32 V; and third and fourth control switches to select one or four possible flash rates of lamps 1 and 2, such as 300, 400, 500 and 600 milliseconds.

Option settings 24 represent a mode switch allowing the operator to select either idle (off) mode or bright mode during the time between flashing of lamps 1 and 2. The mode switch is preferably a two position toggle switch (off/on). The mode switch sends a signal which is either off or on to microcontroller 14 indicating that idle or bright mode, respectively, is selected. The signal from the mode switch is considered active by the microcontroller when a change in its state occurs. In idle mode, microcontroller 14 sets the duty cycle of the PWM1 and PWM2 signals to its low level (i.e., 2%), while in bright mode the microcontroller sets the duty cycle to its high level (i.e., 15% or 100%, depending on the lamps operating voltage). The mode switch is debounced by the microcontroller. Horn switch 20, control switch 22, option settings (mode switch) 24 and test switch 26 may be supplied with 5V operating voltage from power supply 15.

Also note, that all the components in system 10, except for lamps 1 and 2, horn switch 20, test switch 26, mode switch 24 and fault led 28, may be integrated on a circuit board in the railway vehicle.

Figure 3A:
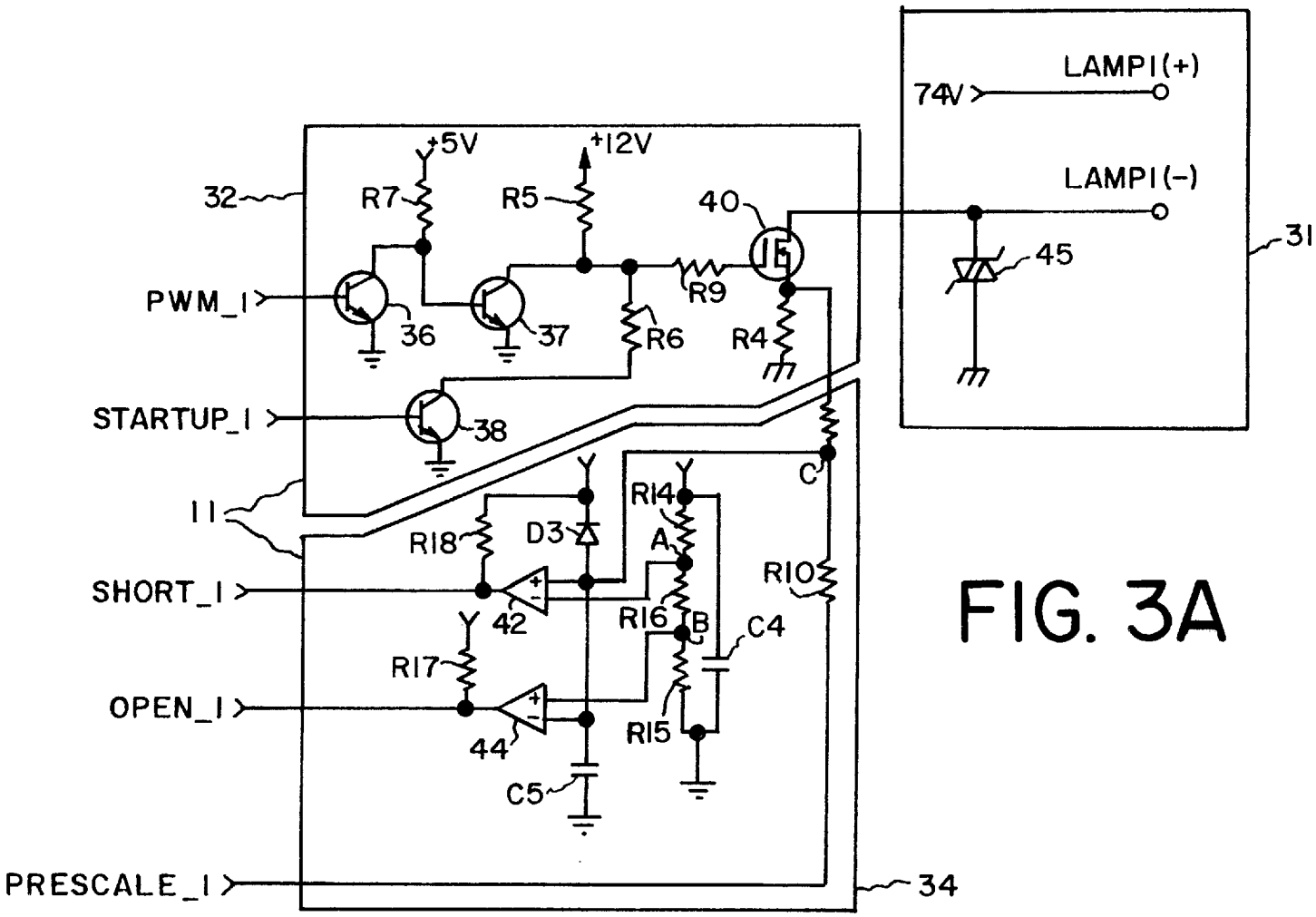
FIG. 3A is a schematic diagram of the lamp driver circuit for the first lamp in the system of FIG. 1.

Referring to FIG. 3A, the circuit is shown of the lamp driver 11 and a lamp circuit 31 for operating lamp 1. Lamp driver 11 is composed of a drive circuit 32 and a sense circuit 34. Driver circuit 32 receives the PWM1 signal from microcontroller 14 at a NPN transistor 36 which inverts the PWM1 signal at its collector. Another NPN transistor 37 receives at its base the inverted signal from NPN transistor 36 and converts the inverted signal from 5 V (max. amplitude) scale to 12 V scale at its collector. The 12 V scale signal from transistor 37 is thus modulated responsive to the PWM1 signal. Resistor R7 is coupled between the collector of NPN transistor 36 and the 5 V power supply, while resistor R5 is coupled between the collector of NPN transistor 37 and the 12 V power supply. Both resistors R5 and R7 limit the current to their respective transistors.

The 12 V scale signal from NPN transistor 37 drives, via resistor R9, the gate of a power MOSFET 40 (N-type) which in turn effects the amount of current flowing between its drain and source. MOSFET 40 may, for example, be a MTW-35N15E, manufactured by Motorola, Inc. of Phoenix, Ariz. The source of MOSFET 40 is connected to ground, via resistor R4, while the drain of MOSFET 40 is connected to the negative terminal of lamp 1 in lamp circuit 31. The positive terminal of lamp 1 is connected to 74 V from battery 17. Thus, since the 12 V scale signal to the gate of MOSFET 40 is modulated responsive to the PWM1 signal, the MOSFET controls the amount of current through lamp 1 responsive to the PWM1 signal. A surge protector 45 may be provided in lamp circuit 31 to protect lamp driver 11 from excessive voltages.

Drive circuit 32 receives from microcontroller 14 a STARTUP1 signal at the base of a NPN transistor 38, which is connected to the collector of NPN transistor 37 via resistor R6. When the STARTUP1 signal is high, NPN transistor 38 turns on. Then, depending on the resistance value of resistor R6, the voltage driving the gate of MOSFET 40 is reduced (or scaled down). By reducing the voltage driving the gate, the amount of current which would otherwise flow through the MOSFET decreases, thereby decreasing the current through lamp 1. Preferably, resistor R6 has a resistance such that the 12 V scale signal driving the gate of MOSFET 40 is reduced by about two-thirds. Thus, microcontroller 14 can temporarily reduce the amount of current though lamp 1 during start up of lamp 1, thereby also reducing its inrush current.

Sense circuit 34 in lamp driver 11 has two current comparators 42 and 44, such as two LM-2901 IC chips. Both the non-inverting input of comparator 42 and the inventing input of comparator 44 are connected to the source of MOSFET 40 via resistor R8, and hence to the current through lamp 1. A diode D3 is connected between 5 V and the inputs of comparators 42 and 44 receiving current from lamp 1 to clamp the voltage level at these inputs such that it does not exceed the 5 V supply voltage to the comparators. The inverting input of comparator 42 is connected to a current of about 10 amperes, while the non-inverting input of comparator 44 is connected to a current of about 250 milliamperes. The 10 A and 240 mA currents are provided at nodes A and B, respectively, in the reference divider network formed by resistors R14, R15, and R16. Comparator 42 compares the current at its non-inverting input with the upper current threshold defined by the current at its inverting input, and outputs a low SHORT1 signal if the current from lamp 1 exceeds the upper current threshold, otherwise the SHORT1 signal is high (via a resistor R18 to 5 V). Comparator 44 compares the current at its inverting input with the lower current threshold defined by the current at its non-inverting input, and outputs a high OPEN1 signal (via a resistor R17 to 5 V) if the current from lamp 1 is below the lower current threshold, otherwise the OPEN1 signal is low. Changes in the SHORT1 and OPEN1 signals are monitored by microcontroller 14. Capacitors C4 and CS are included to filter out noise on the inputs to comparators 42 and 44.

Sense circuit 34 also has a resistor R10 connected at a node C between resistor R8 and inputs of comparators 42 and 44 receiving current through lamp 1. If a low PRESCALE1 signal, i.e., at or near ground, is received from microcontroller 14, resistors R8 and R10 form a current divider. However, if PRESCALE1 signal is at a high resistance, i.e., essentially open, no current divider is formed. Since some lamps draw more current than others, microcontroller 14 by setting the PRESCALE1 signal low can scale down the current received from lamp 1 for use by comparators 42 and 44. The level of current to comparators 42 and 44 are thus determined by the values of resistors R8 and R10. For example, if resistors R8 and R10 are each 100 Kohms, the current from lamp 1 will be at half scale if the PRESCALE1 signal is low, and full scale if the PRESCALE1 signal is at a high resistance.

Alternatively, sense circuit 34 may be replaced by an A/D converter and software of microcontroller 14 in which the A/D converters (either separate or in the microcontroller) converts the current through lamp 1 into a digital value for the microcontroller. The microcontroller compares this digital value to predefined upper and lower current threshold values to determine whether the lamp is shorted or open, respectively. The microcontroller can also scale the digital value from the A/D converter prior to making the above comparison to perform the function of the PRESCALE1 signal.

Figure 3B:
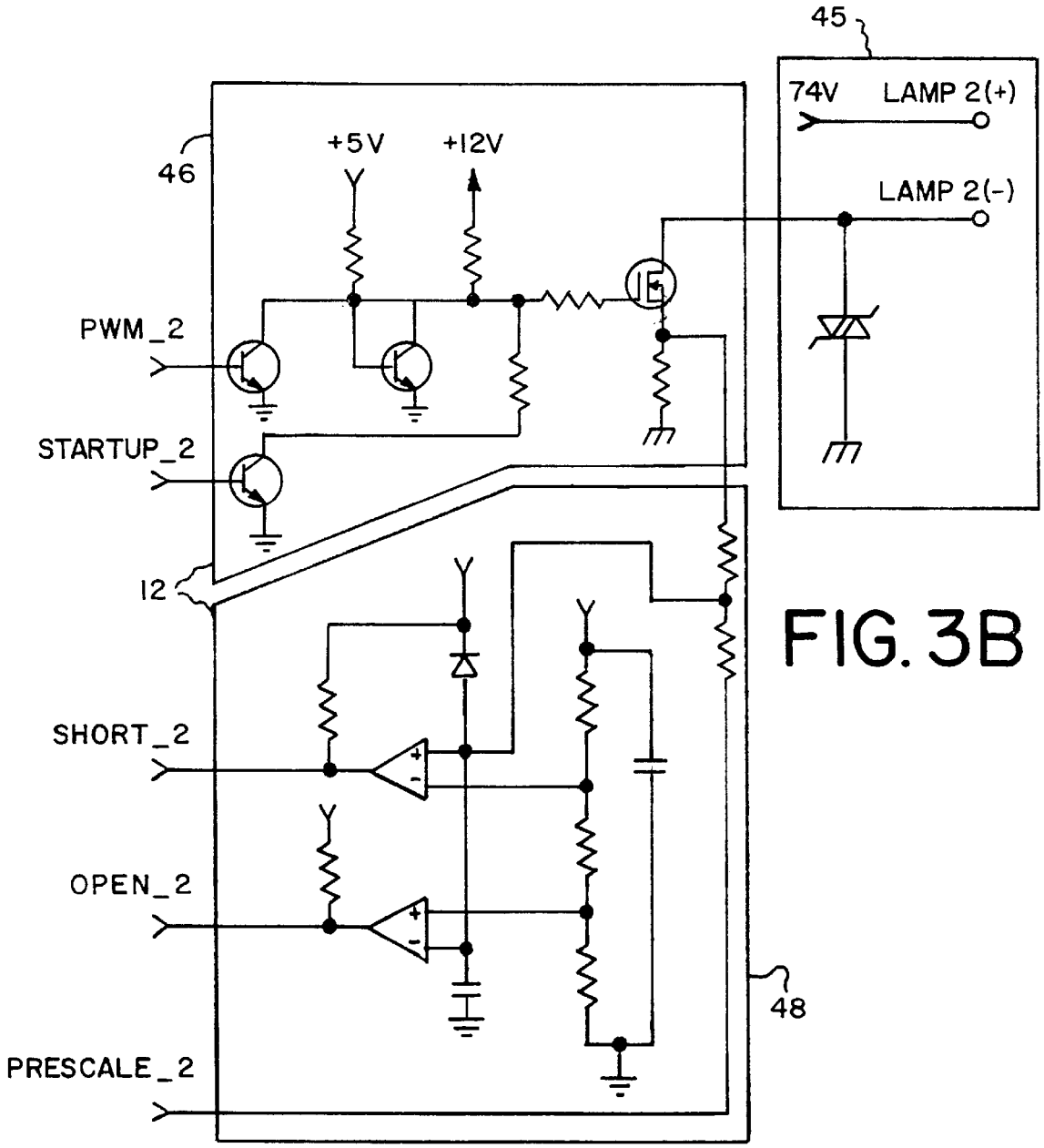
FIG. 3B is a schematic diagram of the lamp driver circuit for the second lamp in the system of FIG. 1.

Referring to FIG. 3B, the circuit is shown of lamp driver 12 and a lamp circuit 45. Lamp driver 12 is composed of a drive circuit 46 and a sense circuit 48, which are identical to driver circuit 32 and sense circuit 34, except that signals PWM1, STARTUP1, SHORT1, OPEN1 and PRESCALE1 correspond to PWM2, STARTUP2, SHORT2, OPEN2 and PRESCALE2, respectively. Further, lamp circuit 45 is identical with lamp circuit 31 in FIG. 3A, but operates lamp 2. Changes in the SHORT2 and OPEN2 signals are monitored by microcontroller 14.

Figure 4:
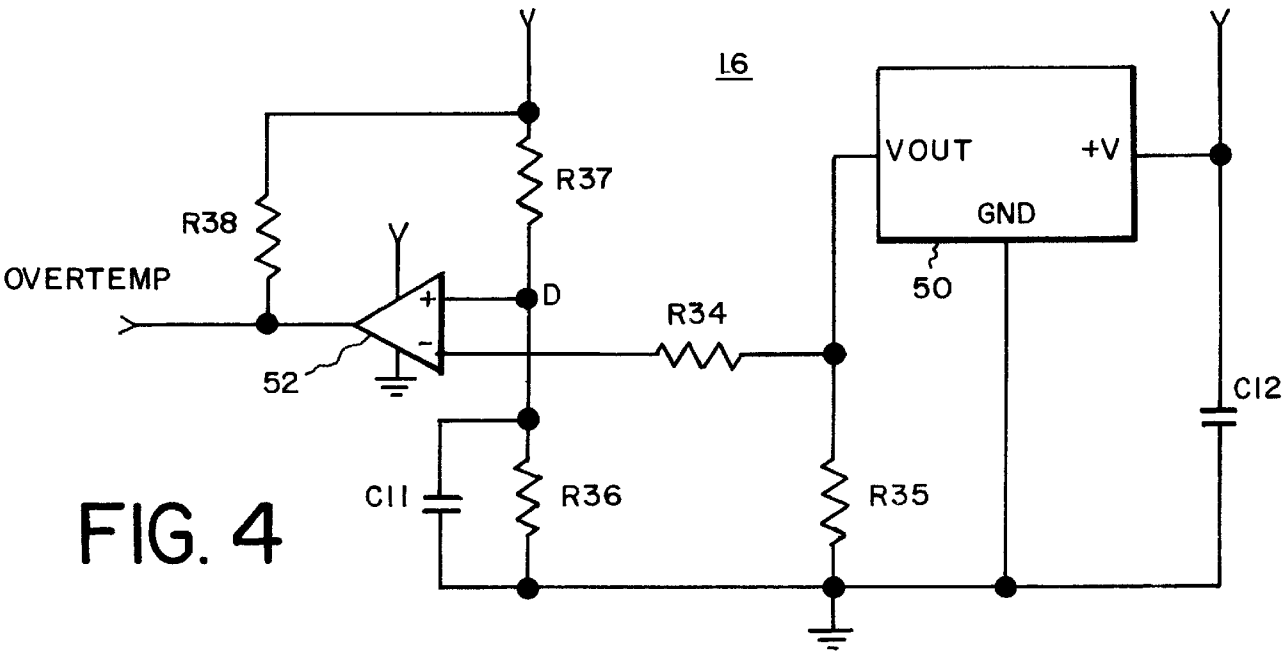
FIG. 4 is a schematic diagram of the over-temperature sensing unit (TEMP) in the system of FIG. 1.

Referring to FIG. 4, the circuit of over-temperature sensing unit 16 is shown having temperature sensor 50 which is situated near both lamp drivers 11 and 12, such as in a heat sink common to drive circuits 32 and 46. Sensor 50 is powered by 5 V (at +V) and provides at Vout an analog output voltage signal representing the temperature of drivers 11 and 12. Sensor 50 may be, for example, a Model LM35 Temperature Sensor manufactured by National Semiconductor, Inc. of Santa Clara, Calif. A comparator 52 is provided having an inverting input which receives Vout via resistor R34. Resistor R34 limits current to the comparator at its inverting input, while a resistor R35 provides a load which may be needed for sensor 50 operation. Comparator 52 may be, for example, a LM2903 IC chip. At the non-inverting input of comparator 52 is a reference voltage representing an upper threshold temperature limit in the range between about 130 to about 150 degrees Celsius, and is provided at node D of the voltage divider formed by resistors R37 and R36, which are connected in series between 5 V and ground. If the voltage representing the temperature of lamp drivers 11 and 12 at the inverting input of comparator 52 exceeds the reference voltage representing the temperature threshold at the non-inverting input of comparator 52, the OVERTEMP signal is active (i.e., low), otherwise the OVERTEMP signal is not active (i.e., high) via resistor R38 to 5 V. Changes in the OVERTEMP signal are monitored by microcontroller 14. Capacitors C11 and C12 in over-temperature sensing unit 16 filter out noise in the reference voltage to comparator 52 and in the 5 V supply voltage to sensor 50, respectively.

Alternatively, over-temperature sensing unit 16 may utilize a mechanical temperature sensor having a bimetallic strip, rather than sensor 50 and comparator 52 to provide the OVERTEMP signal. Further in the alternative, an A/D converter may replace comparator 52 to convert the analog voltage representing the temperature of lamp drivers 11 and 12 into a digital value for microcontroller 14. Then, the microcontroller compares this digital value to a predefined temperature threshold value to determine whether the lamp drivers 11 or 12, or both, are above the temperature threshold. The A/D converter may be a separate component or part of the microcontroller.

Figure 5:
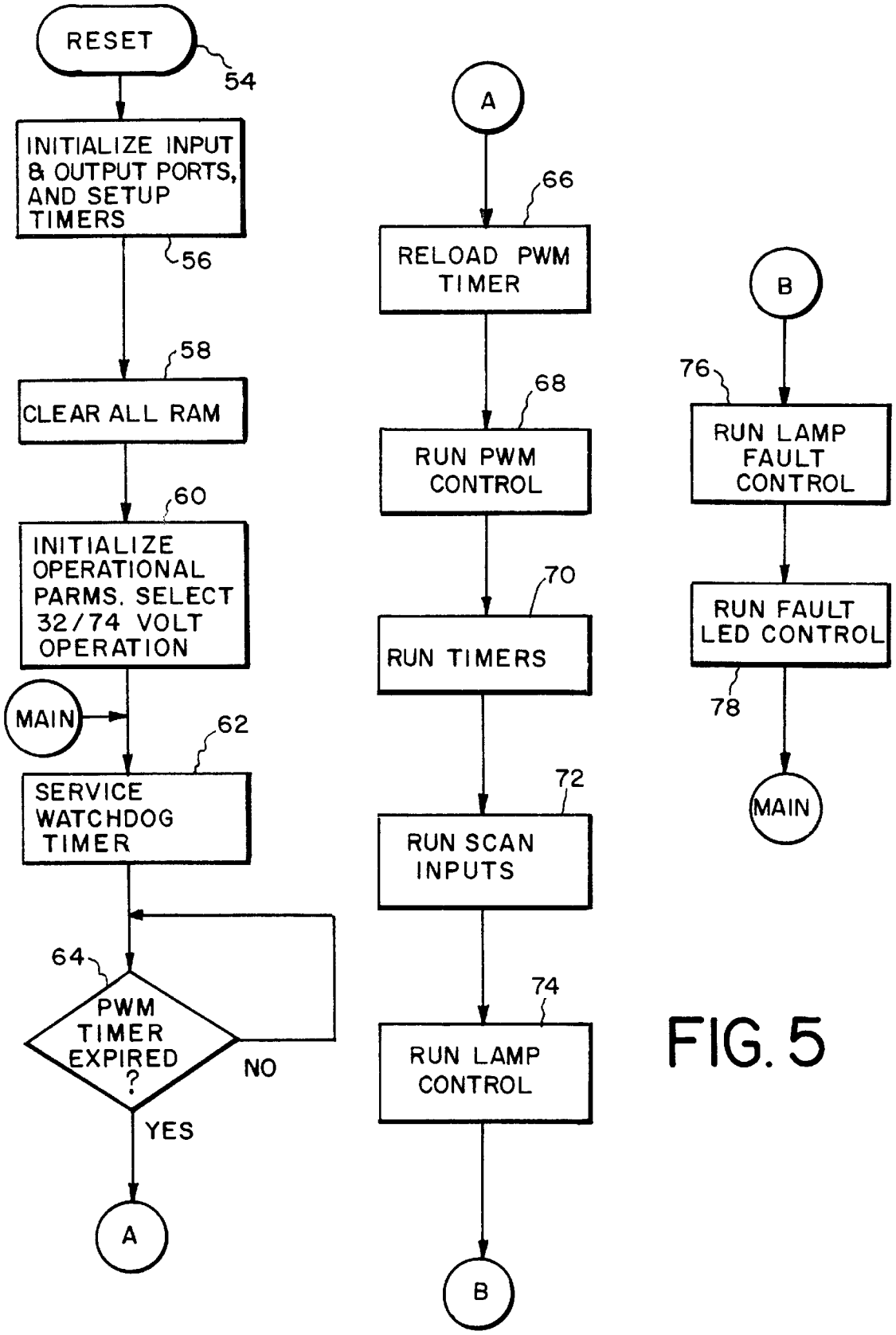
FIG. 5 is a flow chart showing the operation of programmed instructions in the microcontroller of the system of FIG. 1.

The operation of system 10 will now be described in reference to the flow chart of FIG. 5, representing the main program in microcontroller 14, and FIGS. 6A–6G representing the subroutines referenced in FIG. 5. Labelled circles in the figures represent connecting branches.

In FIG. 5, a reset of system 10 first occurs in microcontroller 14 (step 54), such as occurs when the system is first powered up by turning on power supply 15. Upon reset, the program's code in microcontroller 14 is started at its first address. Next, the input and output ports of microcontroller 14 are initialized, and timers are setup as set forth in Table I below (step 56).

TABLE I

| Timer name | Duration of Timer |
|---|---|
| watchdog | 10 mS |
| PWM cycle | 50 μS |
| lamp cycle | 500 mS |
| blink dwell | 30 S |
| preheat1 | 500 mS |
| preheat2 | 500 mS |
| retry1 | 10 S |
| retry2 | 10 S |
| ms500 | 500 mS |
| horn-debounce | 100 mS |
| test-debounce | 100 mS |
| mode-debounce | 100 mS |
| overtemp-debounce | 100 mS |

The timers in Table I operate or trigger based on either a 50 μS, 2.5 mS or 500 mS time base, depending on timer duration and its size in terms of the number of bits. The 50 μS and 2.5 mS time base triggers are generated by the microcontroller internally dividing down the 20 MHz reference signal from the crystal oscillator 18. A 500 mS time base trigger is provided by the ms500 timer in Table I, which cycles every 500 mS responsive to the 2.5 mS time base trigger and upon reaching zero can trigger such timers in Table 1 which are greater than 1 second in duration.

The timers in Table I may each be considered a counter which counts down to zero from a predefined maximum value. The length of time it takes to reach zero from that maximum value represents the timer's duration. Except for cycling timers, such as the ms500 and lamp cycle timers, the timers expire when they are equal to zero. The four debounce timers in Table I may be of different duration and that their duration depends on how long the signal associated with the debounce timer should be received by the microcontroller to assure that the signal is present.

The microcontroller at step 56 also sets up counters and variables, including: a cycle counter (1 to 50), representing which one of the fifty 50 microsecond divisions of the PWM1 and PWM2 period is being outputted by the microcontroller; the variable on-time1 max, representing the highest possible number of divisions in a period the PWM1 signal may be high; the variable on-time2 max, representing the highest possible number of divisions in a period the PWM2 signal may be high; on-time1 counter (1 to on-time1 max), representing the number of 50 microsecond divisions in the period of the PWM1 signal which have been outputted high; on-time2 counter (1 to on-time2 max), representing the number of 50 microsecond divisions in the period of the PWM2 signal which have been outputted high; open circuit flags OC1 and OC2, which if set to 1 allows the microcontroller to skip the open circuit check for lamp 1 and lamp 2, respectively; flags fault 1 and fault 2, which indicate the condition of lamps 1 or 2 as open or shorted, respectively; and flag overtemp, which indicates an overtemp condition of drivers 11 or 12, or both. Both on-time1 max and on-time2 max vary during the program to set the duty cycle of the PWM1 and PWM2 signals, respectively, between about a low level of 1 (2% duty cycle) and about a high level of 8 (15% duty cycle for 32 V operating lamp) or 50 (100% duty cycles for 74 V operating lamp). The function of the timers, counters and flags are further described in the below discussion.

At step 58, the microcontroller clears all the ram, i.e., its volatile memory. Next, the operational parameters of system 10 are initialized at step 60 based on the settings of control switches 22. A first of the control switches 22 selects the number of seconds after horn switch 20 (or test switch 26) is released lamps 1 and 2 will alternatively flash. Responsive to a signal from the first control switch, the microcontroller sets the duration of the blink dwell timer as either the 30 seconds (as shown in Table I) or, for example, 45 seconds. For purposes of illustration, the duration of the blink dwell timer is considered 30 seconds. The second of the control switches 22 selects either 32 V or 74 V operation of lamps 1 and 2. Responsive to a signal from the second control switch, the microcontroller defines the high level for the duty cycle of the PWM1 and PWM2 signals at about 15% for a 32 V operating lamp, or about 100% for a 74 V operating lamp. Specifically, this is achieved by placing an upper limit on both on-time1 max and on-time2 max of 8 (15% duty cycle), or 50 (100% duty cycle). Preferably, a flag is set in the microcontroller at step 60 indicating the selection of either 32 V or 74 V operating lamp voltage, and responsive to this flag, the high level for the duty cycle of PWM1 and PWM2 is defined later in the program (at steps 142 or 144). The third and fourth of the control switches 22 selects one of four flash rates, such as 300, 400, 500, or 600 mS. Responsive to the third and fourth control switches, the microcontroller sets the duration of the lamp cycle timer, which defines the flash rate. For purposes of illustration the duration of the lamp cycle timer is considered 500 mS, i.e., each lamp alternates ½ second on and ½ second off, as shown for example in FIG. 2D.

Also at step 60, the mode of system 10 is initially set to one of idle mode or bright mode between flashing of lamps 1 and 2 by the microcontroller reading the signal from mode switch 24 as one of off or on, representing idle mode and bright mode, respectively. During idle mode, the duty cycle of the PWM1 and PWM2 signals are at about its low level (i.e. 2%) by setting both on-time1 max and on-time2 max to 1. In contrast, during bright mode, the duty cycle of the PWM1 and PWM2 signals is about its high level, which is either 15% or 100% as selected via the second control switch. Thus, in bright mode, on-time1 max and on-time2 max is set to 8 (15% duty cycle), or 50 (100% duty cycle).

Further at step 60, to preheat lamps 1 and 2 after reset, the microcontroller sets both STARTUP1 and STARTUP2 output signals to high, and starts both preheat1 and preheat2 timers from their maximum value. Lamp cycle and ms500 timers are also started at step 60, and each cycle from its maximum value to zero every 500 mS.

At step 62, the watchdog timer is serviced, i.e., set to its maximum value. If the watchdog timer ever expires, system 10 automatically branches to reset (step 54). In other words, if the program does not return to step 62 within the duration of the watchdog timer, system 10 will reset itself as an operational safeguard.

Next, at step 64, microcontroller 14 checks if the PWM cycle timer has expired. The PWM timer has a maximum duration of 50 microseconds ($\mu$S), and was initially started from its maximum value at step 60. Step 64 provides that subsequent steps in the program run every 50 microseconds. Once the PWM timer has expired, it is reloaded and restarted from its maximum value at step 66. The microcontroller then runs the PWM control subroutine at step 68.

Figure 6A:
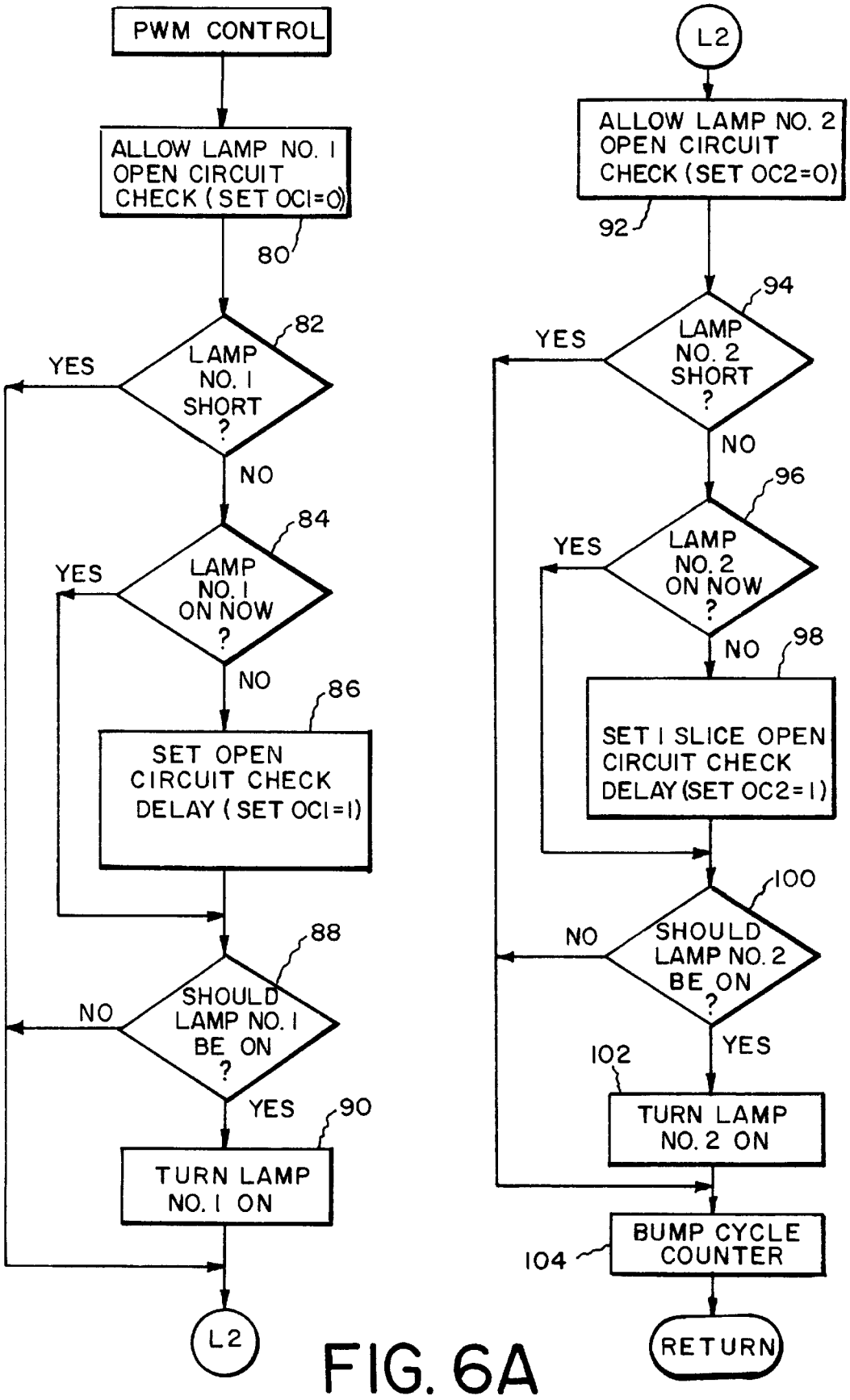
FIG. 6A is a flow chart of the PWM control subroutine block of FIG. 5.

Referring to FIG. 6A, the PWM control subroutine is shown. At step 80, the microcontroller sets OC1 to zero to allow a lamp 1 open circuit check to occur later in the program. Next at step 82, the microcontroller checks if lamp 1 is shorted by checking for a low SHORT1 signal. If lamp 1 is shorted, the microcontroller branches to step 92, otherwise it check at step 84 if lamp 1 is on now by determining whether the on-time1 counter is equal to or less than on-time1 max. If lamp 1 is not shorted and on, the microcontroller branches to step 88, otherwise at step 86 OC1 is set to one to set an open circuit check delay. Branching from either step 84 or step 86, the microcontroller checks at step 88 if lamp 1 should be on by determining whether the cycle counter is below on-time1 max. If so, then at step 90 the microcontroller sets the PWM1 signal high to turn lamp 1 on.

The microcontroller at steps 92–102 perform for lamp 2 the same function as steps 80–90 for lamp 1, for corresponding variables and signals, such as OC2, on-time2 max, and SHORT2. Before returning to the main program of FIG. 5, the PWM control subroutine at step 104 bumps the cycle counter by adding one to the cycle counter.

Figure 6B:
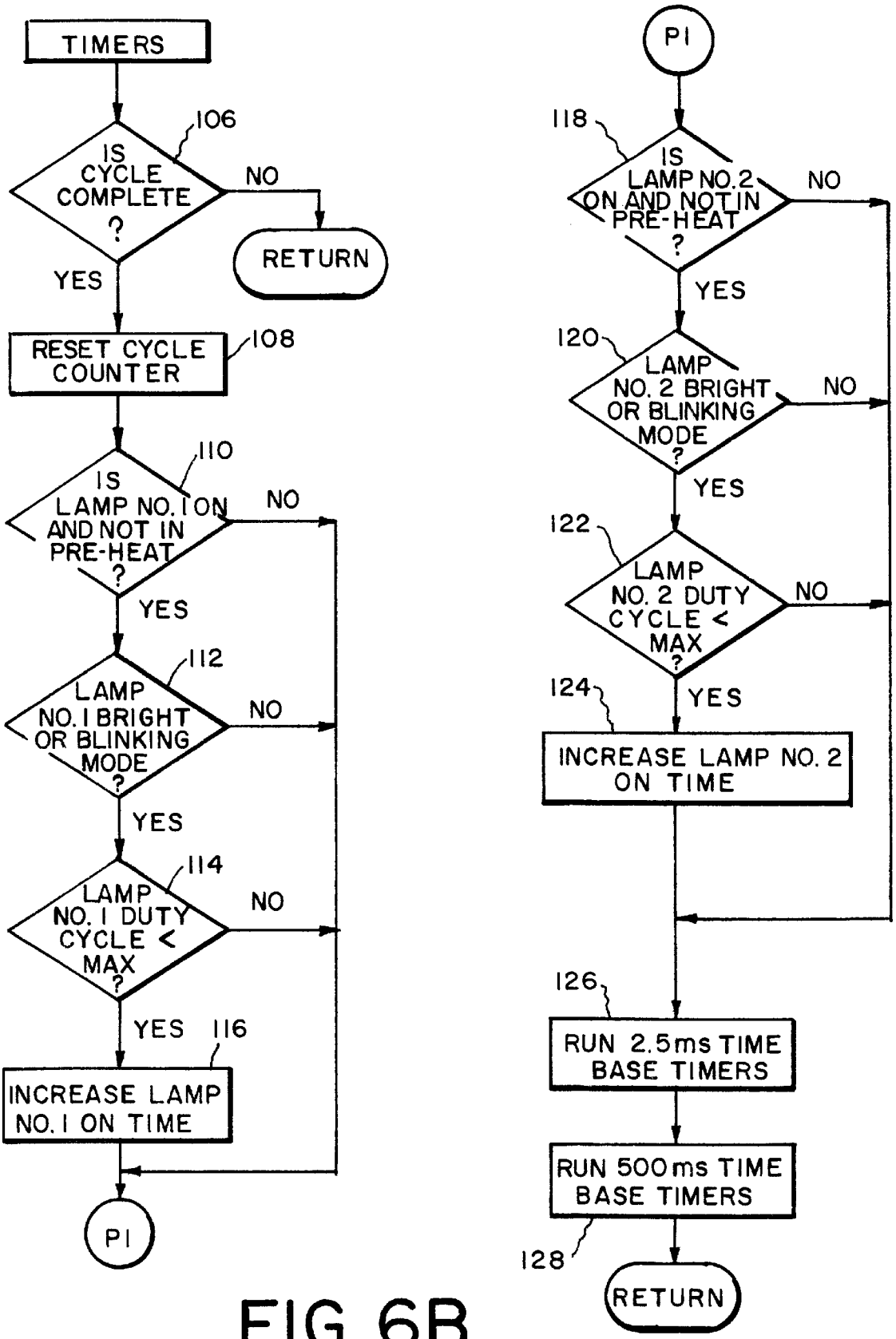
FIG. 6B is a flow chart of the timers subroutine block of FIG. 5.

Next, the microcontroller at step 70 in FIG. 5 runs the timers subroutine shown in FIG. 6B. At step 106, the microcontroller checks if the cycle is complete by determining whether the cycle counter is greater than 50. If the cycle counter is not greater than 50, the timer subroutine returns to the main program of FIG. 5. Thus, steps 108–128 are performed at the end of each period of the PWM1 and PWM2 signals. If the cycle counter is greater than 50, then the cycle counter is reset to zero at step 108. Then, at step 110, the microcontroller checks if lamp 1 is on and not in preheat by determining whether the microcontroller is outputting a high PWM1 signal and a low STARTUP1 signal. If lamp 1 is on and not in preheat, the microcontroller branches to step 112 to check if lamp 1 is in bright mode or blinking (flashing) mode, otherwise it branches from step 110 to step 118. To determine if lamp 1 is in bright mode at step 112, the microcontroller checks the last setting in its memory of the mode switch, while to determine if lamp 1 is blinking, it checks if the blink dwell timer is greater than zero. However, if the system is in bright mode or blinking mode, the microcontroller branches to step 114 to check if the lamp 1 duty cycle is less than maximum, otherwise it proceeds to step 118. To determine whether the lamp 1 duty cycle is less than maximum, the microcontroller checks if the on-time1 counter is less than on-time1 max, if so, the on time of lamp 1 is increased by increasing the on-time1 counter at step 116, otherwise the microcontroller branches to step 118. The amount on-time1 counter increases depends on the size of each step in the ramp up of lamp 1. For example, a maximum number of steps may be provided by the on-time1 counter being increased by 1 at step 116. Thus, the present duty cycle, defined by on-time1 counter, is gradually increased until the maximum duty cycle for PWM1 is reached, defined by on-time1 max.

The microcontroller at steps 118–124 performs for lamp 2 the same function as steps 110–116 for lamp 1, for corresponding variables and signals, such as on-time2 counter, on-time2 max, STARTUP2, and PWM2. Before returning to the main program of FIG. 5, steps 126 and 128 run the 2.5 millisecond time base and 500 millisecond time base timers, respectively. The 2.5 millisecond time base timers represent the horn-debounce, test-debounce, mode-debounce, and overtemp-debounce timers, herein after called the debounce timers. Any one of horn-debounce, test-debounce, overtemp-debounce, or mode-debounce timers is started here from its maximum value if the microcontroller is receiving an active signal from the horn switch 20, test switch 26, over-temperature sensing unit 16, or mode switch 24, respectively. After any of the debounce timers are started, the microcontroller periodically monitors the state of the signal associated with the timer until the timer expires to determine whether on average the state of the signal is the same as when the timer was started. If so, the microcontroller considers the switch associated with the timer debounced, or for unit 16, that an active OVERTEMP signal is debounced. If after a debounce timer is started the state of the signal associated with the timer is not on average the same as when the timer was started, the timer may be reset to its maximum value. Although it is preferred that horn switch 20, test switch 26, over-temperature sensing unit 16, and mode switch 24 are debounced by the microcontroller, it is not essential.

The 500 millisecond time base timers represent the blink dwell, retry1 and retry2 timers, which are each started in step 128 if set or loaded with a value. The loading of these timers occurs later in the program. The ms500 timer provides the 500mS time base for triggering the blink dwell, retry1 or retry2 timers every ½ second as they count down to zero. For example, the blink dwell timer may have a maximum value of 60 and is counted down each time the ms500 timer reaches zero to provide a 30 second duration (i.e., 60 multiplied by 500 mS equals 30 seconds).

Figure 6C:
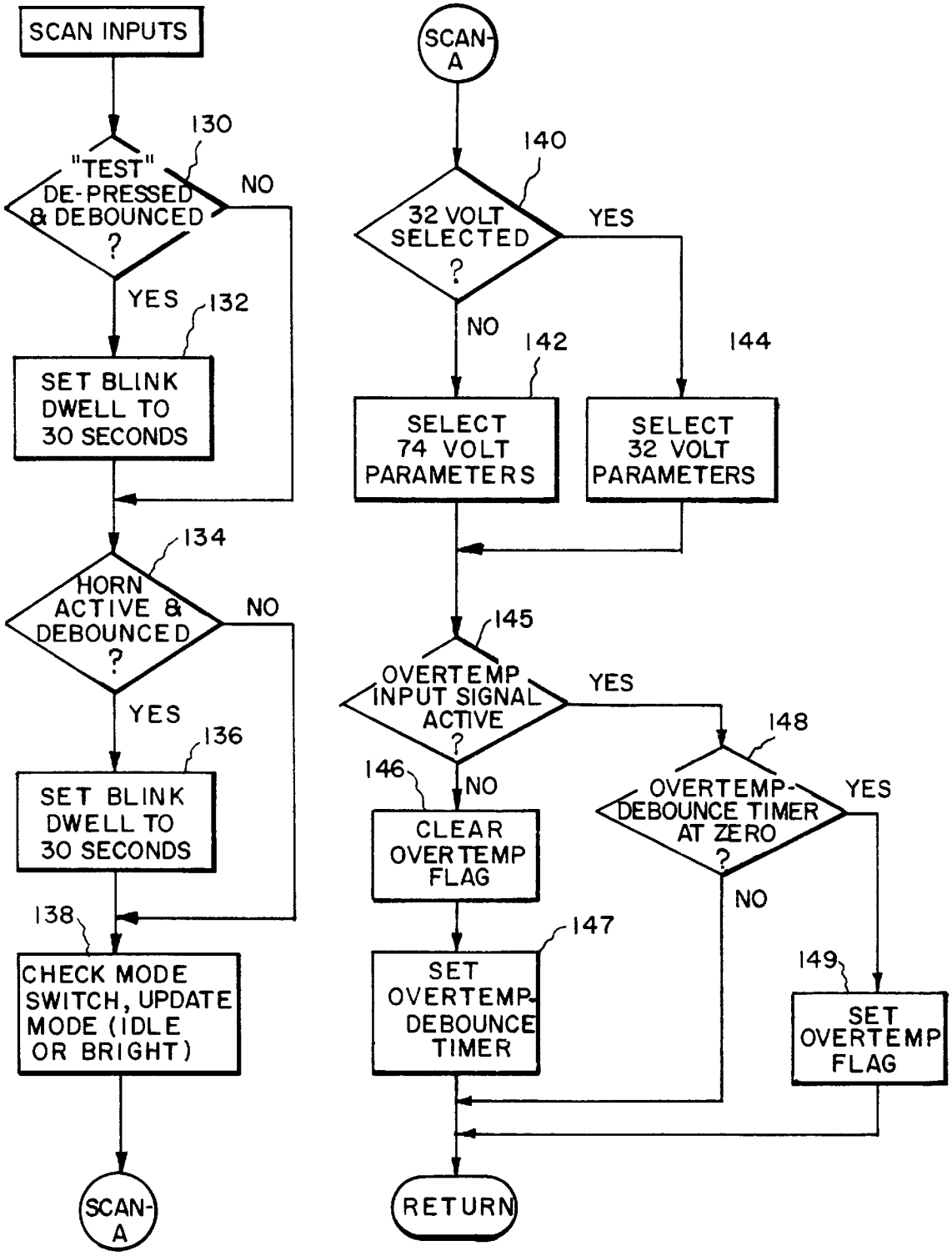
FIG. 6C is a flow chart of the scan inputs subroutine block of FIG. 5.

Next, the microcontroller at step 72 in FIG. 5 runs the scan inputs subroutine shown in FIG. 6C. At step 130, the microcontroller checks if test switch 26 is depressed and debounced by determining if the signal from the test switch is active and that the test-debounce timer has expired. If test switch 26 is depressed and debounced, then the blink timer is set for 30 seconds (i.e., loaded to its maximum value) at step 132, otherwise, the microcontroller branches to step 134. Similarly, at step 134, if the horn has been activated (i.e., the signal from the horn switch 20 is active) and debounced (i.e., the horn-debounce timer has expired), then the blink timer is set for 30 seconds (i.e., loaded to its maximum value) at step 136, otherwise the microcontroller proceeds to step 138. If blink dwell timer is set at either steps 132 or 134, then the duty cycle of the PWM1 and PWM2 signals are set at low and high levels, respectively, by setting on-time1 max to 1 and on-time2 max to 8 or 50 (depending on the setting of the second control switch for either 32 V or 74 V lamp operating voltage).

At step 138, mode switch 24 is checked by the microcontroller. To check the mode switch, the microcontroller checks whether the mode switch is debounced (i.e., the mode-debounce timer has expired). If so, the microcontroller reads the signal from mode switch 24 and updates accordingly the setting of the mode in its memory as either idle or bright mode. Debouncing the test, horn and mode switches assures that spurious signals from these switches, i.e., signals which are not the result of the operator activating or toggling the switch, do not effect system 10 operation.

Then, at step 140 the microcontroller determines if 32 V operation was selected by the operator at step 60, such as by checking a flag in its memory indicating if 32 V operating lamp voltage was selected. If so, then parameters for 32 V operation are selected at step 142 by setting the high level of the duty cycle for PMW1 and PWM2 to 15%, i.e., the highest possible level (or limit) for both on-time1 max and on-time2 max is 8. If 32 V is not selected, then the parameters for 74 V operation are selected by setting the high level of the duty cycle for PMW1 and PWM2 to 100%, i.e., the highest possible level (or limit) for both on-time1 max and on-time2 max is 50.

At step 145, the microcontroller checks whether the OVERTEMP input signal is active (i.e., low). If the OVERTEMP signal is not active (i.e., high), the microcontroller clears the overtemp flag (step 146) and sets the overtemp-debounce timer to its maximum value (step 147). If the OVERTEMP signal is active, the microcontroller at step 148 checks if the overtemp-debounce timer is at zero to determine if it has expired, and if so, sets the overtemp flag (step 149). After either steps 147, 148, or 149, the scan inputs subroutine returns to FIG. 5.

Figure 6D:
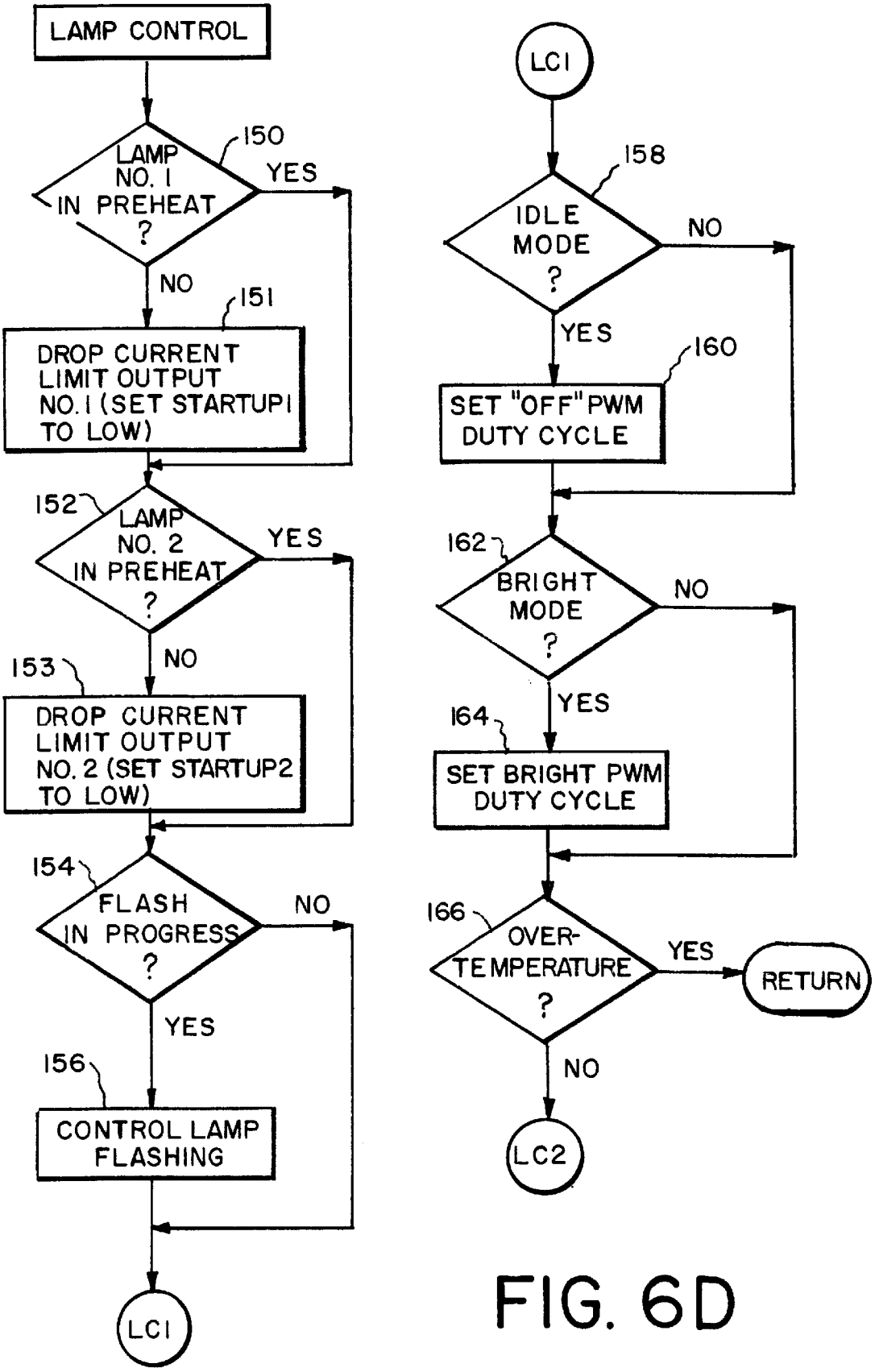
FIG. 6D is a flow chart of the lamp control subroutine block of FIG. 5.
Figure 6E:
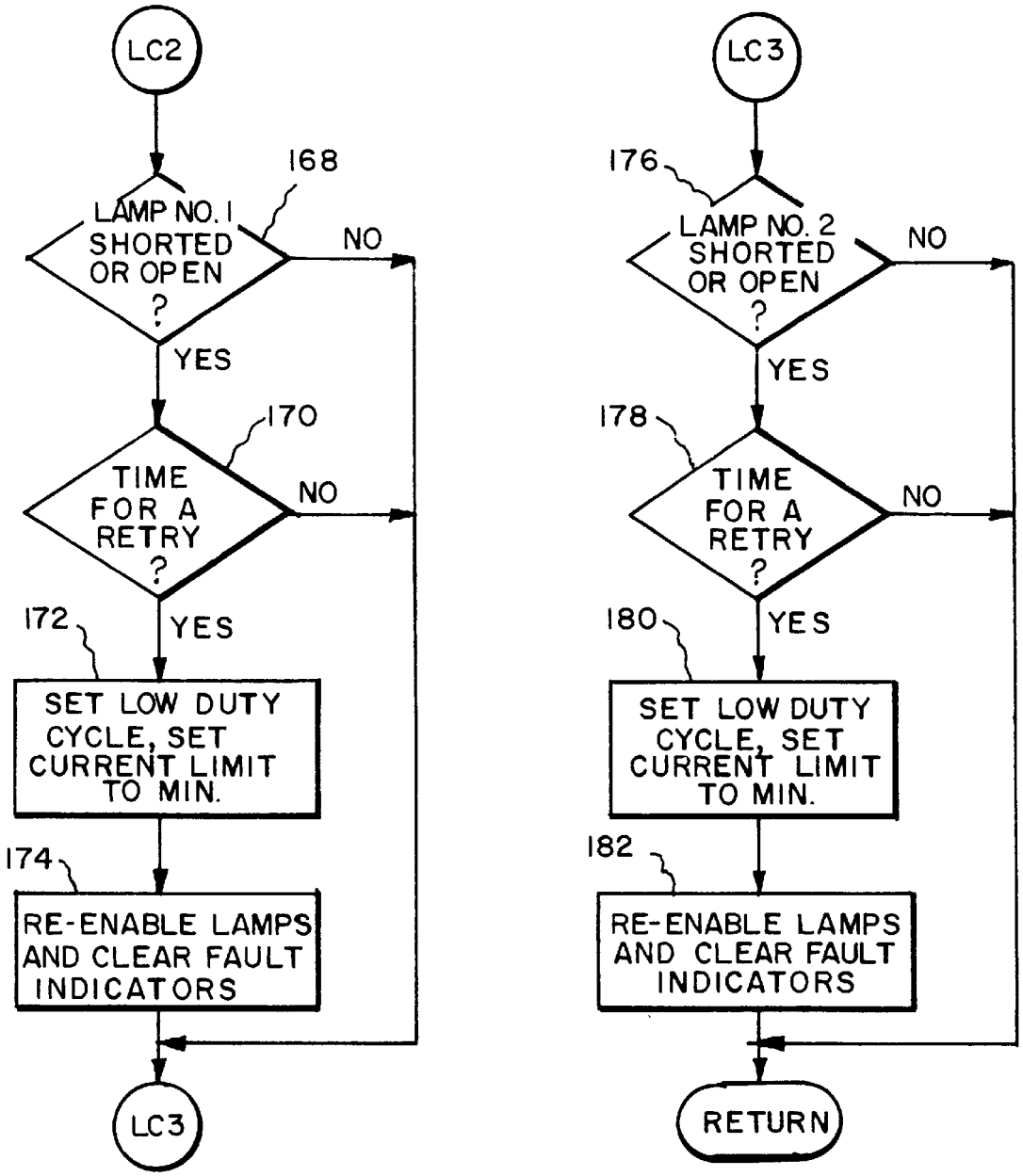
FIG. 6E is a continuation of the flow chart of FIG. 6D.

The microcontroller next at step 74 in FIG. 5 runs the lamp control subroutine shown in FIGS. 6D and 6E. At step 150, the microcontroller checks if lamp 1 is in preheat by determining whether the preheat1 timer is greater than zero. If lamp 1 is not in preheat, the microcontroller sets the STARTUP1 signal low (step 151), otherwise it proceeds to step 152. At step 152, the microcontroller checks if lamp 2 is in preheat by determining whether the preheat2 timer is greater than zero. If lamp 2 is not in preheat, then the microcontroller sets the STARTUP2 signal to low (step 153), otherwise its proceeds to step 154.

To determine if lamps 1 and 2 are in blinking mode, the microcontroller checks if a flash is in progress (step 154), i.e., is the blink dwell timer greater than zero. If yes, then at step 156, the flashing of lamps 1 and 2 are controlled, otherwise a branch is taken to step 158. To control lamp flashing, the microcontroller checks whether the lamp cycle timer equals zero, and if so, it alternates the on and off states of the lamps. For example, if lamp 1 is on and lamp 2 is off, the duty cycles of the PWM1 and PWM2 signals are reset by setting on-time1 max to 1 (for a 2% PWM1 duty cycle) and on-time2 max to either 8 (for 32 V lamp operation to later increase PWM2 up to 15% duty cycle) or 50 (for 74 V lamp operation to later increase PWM2 up to 100% duty cycle) depending on whether 74 V or 32 V parameters (i.e., upper limits of on-time1 max and on-time2 max) were set at step 142 or 144 in FIG. 6C. If lamp 1 is off and lamp 2 is on, then the opposite of the above occurs for on-time1 max and on-time2 max. In addition to setting on-time1 max and on-time2 max, the on-time1 counter and on-time2 counters are re-initialized by setting each counter to 1.

Next, at step 158, the microcontroller check if lamps 1 and 2 should be in idle mode. To determine this, the microcontroller checks whether the mode setting stored in its memory (updated at step 138 of FIG. 6C) of the second control switch indicates idle mode, as well whether lamps 1 and 2 are not in blinking mode (i.e., the blink dwell timer is equal to zero). If so, the microcontroller at step 160, sets the PWM1 and PWM2 in an idle mode duty cycle, i.e. the low duty cycle level of 2%, by setting both on-time1 max and on-time2 max to 1. Similarly at step 162, the microcontroller checks if lamps 1 and 2 should be in bright mode, rather than in a blinking or idle mode, by checking the stored mode setting and the blink dwell timer. If so, the microcontroller at step 164, sets the PWM1 and PWM2 signals in a bright mode duty cycle, i.e., the high duty cycle level of 15% (for a 32 V operating lamp) or 100% (for a 74 V operating lamp), depending on whether 74 V or 32 V parameters were set at steps 142 or 144 in FIG. 6C. This is done by setting the high level for both on-time1 max and on-time2 max at 8 (for 32 V operating lamp) or at 50 (for 74 V operating lamp).

Next, the microcontroller checks for over-temperature of lamp driver 11 and 12 by determining whether the OVERTEMP signal is active and debounced (i.e., overtemp-debounce timer has expired), or alternatively, whether the overtemp flag is set. If so, the lamp control subroutine returns to FIG. 5, otherwise, it proceeds to step 168 in FIG. 6E. At step 168, the microcontroller checks if lamp 1 is shorted or open by checking for a low SHORT1 signal, or a high OPEN1 signal. If lamp 1 is shorted or open, the microcontroller sets a short or open fault indicator, i.e., the fault 1 flag, and branches to step 170, otherwise it branches to step 176. At step 170, the microcontroller checks if it is time for retry of lamp 1 by checking if retry1 timer has expired. If it is time to retry lamp 1, the microcontroller at step 172 sets lamp 1 to its low duty cycle level (i.e., 2%) in which on-time1 max is set to 1, and sets the current limit to minimum by setting the STARTUP1 signal to high (step 172). After step 172, the PWM1 signal is re-enabled by the microcontroller and the fault indicator for ML-406 lamp 1, the fault 1 flag, is cleared (step 174). If it is not time to retry lamp 1 at step 170, the microcontroller branches to step 176.

The microcontroller at steps 176–182 performs for lamp 2 the same function as steps 168–174 for lamp 1, for corresponding variables, timer, and signals, such as SHORT2, OPEN2, retry2 timer, PWM2, fault 2 flag, and on-time2 max. Thereafter, the microcontroller returns to FIG. 5.

Figure 6F:
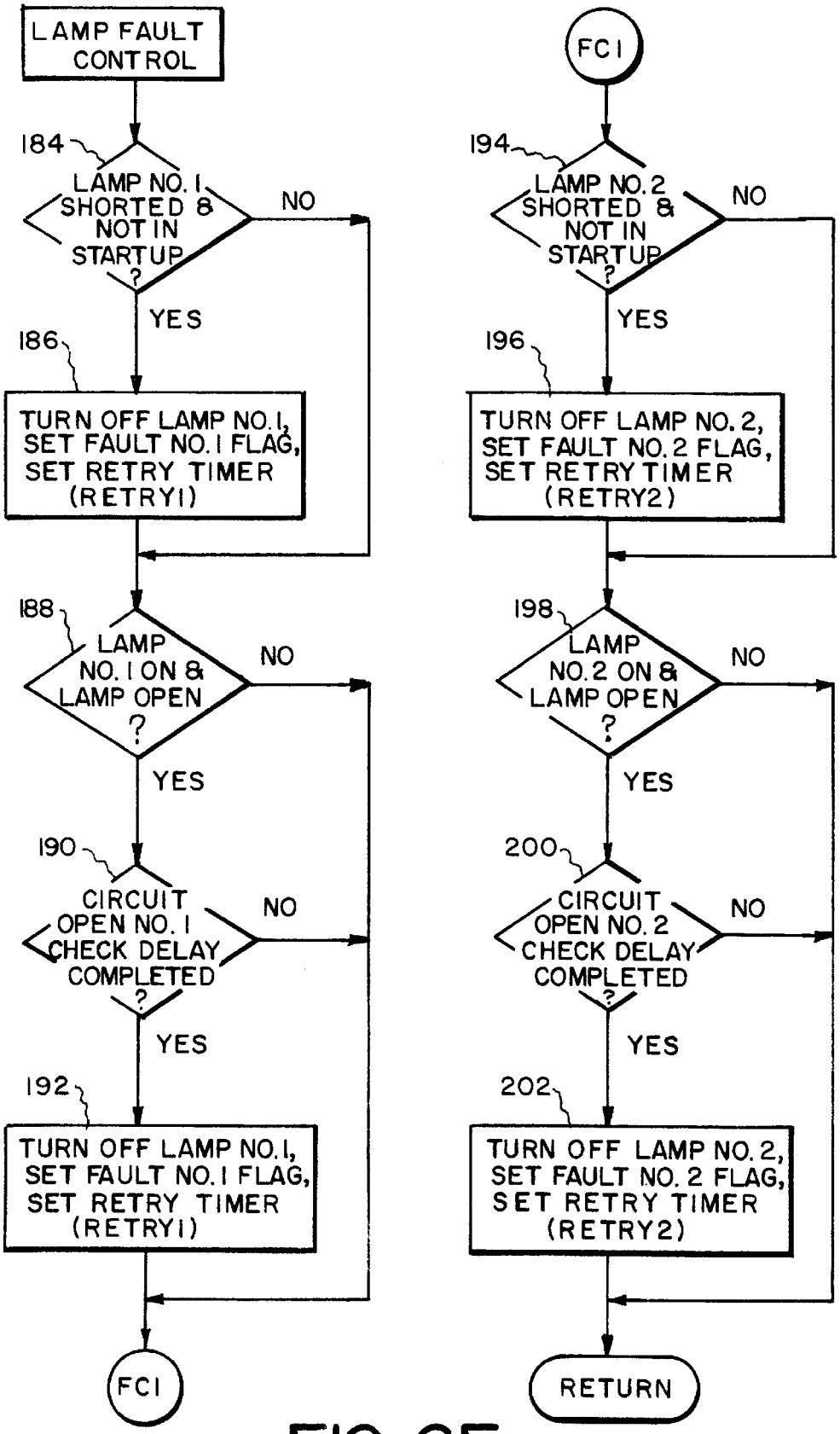
FIG. 6F is a flow chart of the lamp fault control subroutine block of FIG. 5.

The microcontroller next at step 76 in FIG. 5 runs the lamp fault control subroutine in FIG. 6F. At step 184, the microcontroller checks if lamp 1 is shorted and not in startup by checking whether the SHORT1 signal is low and the STARTUP1 signal is high. If lamp 1 is shorted and not in startup, then at step 186 lamp 1 is turned off (by disabling the PWM1 signal output to lamp driver 11), the fault 1 flag is set, and retry1 timer is set to its maximum value. From either step 186 or the no branch from step 184, the microcontroller at step 188 checks if lamp 1 is on and open by determining whether the PWM1 signal is high and the OPEN1 signal is high. If lamp 1 is on and open, then at step 190 the microcontroller checks if open circuit check delay is completed by determining if OC1 equals 1, if so, it branches to step 194. If OC1 equals 0, the microcontroller branches to step 192 where lamp 1 is turned off (by disabling the PWM1 signal output to lamp driver 11), the fault 1 flag is set, and retry1 timer is set to its maximum value. Although the retry1 timer is indicated as 10 seconds in duration in Table 1, it may be of any sufficient waiting period to attempt recovery of lamp 1. Further note, that by disabling lamp 1 when it is shorted or open, the lamp driver 11 for lamp 1 is protected from possible damage.

The microcontroller at steps 194–202 performs for lamp 2 the same function as steps 184–192 for lamp 1, for corresponding variables, timers, and signals, such as SHORT2, OPEN2, PWM2, STARTUP2, the fault 2 flag, and retry2 timer. Next, the microcontroller returns to FIG. 5.

Figure 6G:
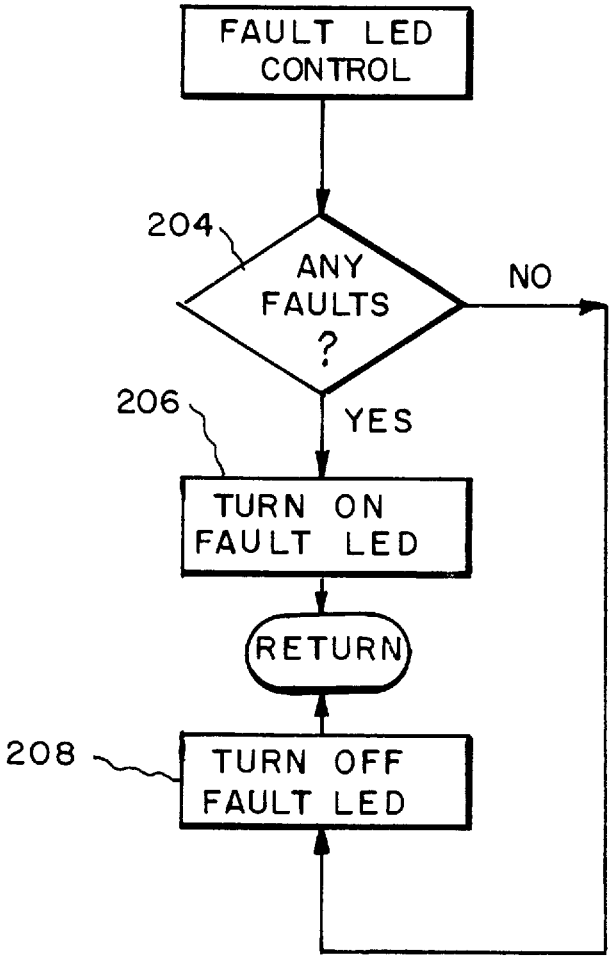
FIG. 6G is a flow chart of the fault led control subroutine block of FIG. 5.

In FIG. 5, the microcontroller runs the fault led control subroutine at step 78 in FIG. 6G. At step 204, the microcontroller checks for any faults by determining whether either fault 1, fault 2, or overtemp flags have been set. If not, the fault led is turned off at step 208 by the microcontroller disabling the FAULT signal to fault led 28 (FIG. 1). If any of the fault flags have been set, then at step 206, the fault led is turned on by the microcontroller enabling the FAULT signal to fault led 28. After either step 206 or 208, the microcontroller returns to FIG. 5 where it branches to step 62 and again loops through steps 62–78.

In the alternative to defining a 2% low duty cycle level for the PWM1 and PWM2 signals, a greater low duty cycle level may be used by increasing the starting value of the on-time1 and on-time2 counters during system 10 operation. For example, a 4 k low duty cycle level is achieved by setting the starting value of on-time1 and on-time2 counters to 2, rather than 1. This may be desireable for higher operating voltage lamps, such as 100 V, to sufficiently preheat the lamps in idle mode or when off during blinking mode. (For a 100 V operating voltage lamp, 100 V, rather than 74 V, needs to be supplied to system 10 via battery 17 of FIG. 1). Further, the high duty cycle level defined for PWM1 and PWM2 signals is set by the upper limit of on-time1 max and on-time2 max, and depends on the duty cycle which provides an effective lamp voltage about the operating voltage of the lamps.

Listed below are values for resistors, diodes, and capacitors in FIG. 3A and 4. Components in FIG. 3B are identical to those for FIG. 3A. These values are exemplary.

| | | | |
|---|---|---|---|
| R4 | 0.1 ohm | R18 | 33 kohm |
| R5 | 1.0 kohm | R34 | 100 kohm |
| R6 | 2.0 kohm | R35 | 47 ohm |
| R7 | 22 kohm | R36 | 150 kohm |
| R8 | 100 kohm | R37 | 470 kohm |
| R9 | 100 ohm | R38 | 33 kohm |
| R10 | 100 kohm | D3 | 1N4004 |
| R14 | 47 kohm | C4 | 0.1 μF |
| R15 | 3.3 kohm | C5 | 100 pF |
| R16 | 33 kohm | C11 | 0.1 μF |
| R17 | 33 kohm | C12 | 0.1 μF |

From the foregoing description, it will be apparent that there has been provided an improved visual warning system and method for a railway vehicle. Variations and modifications in the herein described system and method in accordance with the invention will undoubted suggest themselves to those skilled in the art. Accordingly, the foregoing description should be taken as illustrative and not in a limiting sense.

What is claimed is:

1. A visual warning system for a railway vehicle comprising:

a first lamp and second lamp;

a first lamp driver for driving said first lamp responsive to a first pulse width modulated signal;

a second lamp driver for driving said second lamp responsible to a second pulse width modulated signal; and a controller for producing said first and second pulse width modulated signals in which the duty cycle of said first and second pulse width modulated signals is varied between high and low levels to alternatively turn said first and second lamps approximately fully on and approximately fully off, wherein said controller comprises means for changing the duty cycle of said first and second pulse width modulated signals from said low level to said high level in which said duty cycle is of at least one other level intermediate said low and high levels while changing between said low and high levels.

2. A visual warning system for a railway vehicle comprising:

a first lamp and a second lamp;

a first lamp driver for driving said first lamp responsive to a first pulse width modulated signal;

a second lamp driver for driving said second lamp responsive to a second pulse width modulated signal, and a controller for producing said first and second pulse width modulated signals in which the duty cycle of said first and second pulse width modulated signals is varied between high and low levels to alternatively turn said first and second lamps approximately fully on and approximately fully off wherein said controller to turn approximately fully on said first lamp increases step-wise said duty cycle of said first pulse width modulated signal from said low level to said high level, and to turn approximately fully on said second lamp increases step-wise said duty cycle of said second pulse width modulated signal from said low level to said high level.

3. A visual warning system for a railway vehicle comprising:

a first lamp and a second lamp;

a first lamp driver for driving said first lamp responsive to a first pulse width modulated signal;

a second lamp driver for driving said second lamp responsive to a second pulse width modulated signal:

a controller for producing said first and second pulse width modulated signals in which the duty cycle of said first and second pulse width modulated signals is varied between high and low levels to alternatively turn said first and second lamps approximately fully on and approximately fully off;

a horn switch for operating a horn which produces an audible signal from said vehicle; and said controller further comprises means when said switch is not depressed for maintaining both said first and second pulse width modulated signals in one of said low and high duty cycle levels, means when said horn switch is depressed for varying said first and second pulse width modulated signals between said high and low duty cycle levels to alternatively turn said first and second lamps approximately fully on and off, and when said horn switch is released for operating said varying means for a predefined period.

4. A visual warning system for a railway vehicle comprising:

a first lamp and a second lamp;

a first lamp driver for driving said first lamp responsive to a first pulse width modulated signal;

a second lamp driver for driving said second lamp responsive to a second pulse width modulated signal, a controller for producing said first and second pulse width modulated signals in which the duty cycle of said first and second pulse width modulated signals is varied between high and low levels to alternatively turn said first and second lamps approximately fully on and approximately fully off, wherein said first and second lamp drivers each further comprise means for sensing when said first and second lamps, respectively, are in one of open and shorted conditions.

5. The system according to claim 4 further comprising at least one fault indicator, wherein said controller further comprises means, responsive to said sensing means of said first and second lamp drivers, for enabling said fault indicator when one of said first and second lamps are in one said open and shorted conditions.

6. The system according to claim 4 wherein said controller further comprises means, responsive to the sensing means of said first lamp driver, for attempting recovery of said first lamp after a predefined interval after the sensing means of said first lamp driver has sensed one of said open and short conditions, and, responsive to the sensing means of said second lamp driver, for attempting recovery of said second lamp after a predefined interval after the sensing means of said second lamp driver has sensed one of said open and short conditions.

7. The system according to claim 6 further comprising a temperature sensor for sending a temperature signal to said controller when the temperature of one of said first and second lamp drivers exceeds a temperature threshold, wherein said controller does not operate said attempting recovery means when said temperature signal is received.

8. The system according to claim 1 wherein said first and second lamp drivers each further comprise means responsive to said controller for preheating their respective first and second lamps for a predefined interval before said first and second lamps are alternately turned approximately fully on and approximately fully off.

9. The system according to claim 1 wherein said first lamp driver further comprises a first MOSFET coupled to said first lamp for controlling the current through said first lamp responsive to the voltage applied to the gate of said first MOSFET, and first means for converting said first pulse width modulated signal into a corresponding modulated voltage to the gate of said first MOSFET, and said second lamp driver further comprises a second MOSFET coupled to said second lamp for controlling the current through said second lamp responsive to the voltage applied to the gate of said second MOSFET, and second means for converting said second pulse width modulated signal into a corresponding modulated voltage to the gate of said second MOSFET.

10. The system according to claim 9 wherein said first and second lamp drivers each further comprise means responsive to said controller for preheating their respective first and second lamps by reducing the level of modulated voltage to said first and second MOSFETS, respectively for a predefined interval.

11. A visual warning system for a railway vehicle comprising:

a first lamp and a second lamp;

a first lamp driver for driving said first lamp responsive to a first pulse width modulated signal;

a second lamp driver for driving said second lamp responsive to a second pulse width modulated signal;

a controller for producing said first and second pulse width modulated signals in which the duty cycle of said first and second pulse width modulated signals is varied between high and low levels to alternatively turn said first and second lamps approximately fully on and approximately fully off;

said first lamp driver further comprising a first MOSFET coupled to said first lamp for controlling the current through said first lamp responsive to the voltage applied to the gate of said first MOSFET, and first means for converting said first pulse width modulated signal into a corresponding modulated voltage to the gate of said first MOSFET, and said second lamp driver further comprises a second MOSFET coupled to said second lamp for controlling the current through said second lamp responsive to the voltage applied to the gate of said second MOSFET, and second means for converting said second pulse width modulated signal into a corresponding modulated voltage to the gate of said second MOSFET, wherein said first and second drivers each further comprising means for comparing the current through said first and second MOSFET, respectively, to first and second current thresholds, wherein said second current threshold is greater than said first threshold, to provide an open signal to said controller when said current through said first and second MOSFET, respectively, is below said first threshold, and to provide a short signal to said controller when said current through said first and second MOSFET, respectively, exceeds said second threshold.

12. The system according to claim 11 further comprising at least one fault indicator responsive to said controller which indicates when said controller has received one of said open and short signals from one of said first and second drivers.

13. The system according to claim 11 wherein said controller further comprises means for recovering said first and second lamps, respectively, after a predefined interval after the controller has received one of said open and short signals from said first and second drivers, respectively.

14. The system according to claim 13 further comprising a temperature sensor for sending an overtemperature signal to said controller when the temperature of one of said first and second lamp drivers exceeds a temperature threshold, wherein said controller does not operate said recovering means when said overtemperature signal is received.

15. The system according to claim 1 wherein said low level of the duty cycle of said first and second pulse width modulated signals is about 2%, and said high level of the duty cycle of said first and second pulse width modulated signals is between about 15% to about 100%.

16. A method of illuminating railway track with a pair of lamps mounted on a train comprising the steps of:

driving a first of said lamps responsive to a first pulse width modulated signal;

driving a first of said lamps responsive to a second pulse width modulated signal; and producing said first and second pulse width modulated signals by varying the duty cycle of said first and second pulse width modulated signals between high and low levels to alternatively turn said first and second lamps approximately fully on and approximately fully off, wherein said duty cycle of said first and second pulse width modulated signals is of at least one other level intermediate said low and high levels when said duty cycle varies from said low level to said high level.

17. A method of illuminating railway track with a pair of lamps mounted on a train comprising the steps of:

driving a first of said lamps responsive to a first pulse width modulated signal;

driving a second of said lamps responsive to a second pulse width modulated signal; and producing said first and second pulse width modulated signals by varying the duty cycle of said first and second pulse width modulated signals between high and low levels to alternatively turn said first and second lamps approximately fully on and approximately fully off; wherein said producing step further comprises the steps of increasing step-wise said duty cycle of said first pulse width modulated signal from said low level to said high level to turn approximately fully on said first lamp, and increasing step-wise said duty cycle of said second pulse width modulated signal from said low level to said high level to turn approximately fully on said second lamp.

18. A method of illuminating railway track with a pair of lamps mounted on a train comprising the steps of:

driving a first of said lamps responsive to a first pulse width modulated signal;

driving a second of said lamps responsive to a second pulse width modulated signal;

producing said first and second pulse width modulated signals by varying the duty cycle of said first and second pulse width modulated signals between high and low levels to alternatively turn said first and second lamps approximately fully on and approximately fully off;

producing an audible signal from a horn which is operated by a switch;

maintaining both said first and second pulse width modulated signals in one of said low level and high duty cycle levels when said switch is not depressed;

varying said first and second pulse width modulated signals between high and low duty cycle levels to alternatively turn said first and second lamps approximately fully on and off when said switch is depressed; and carrying out said varying step for a predefined period after said switch is released.

19. A method of illuminating railway track with a pair of lamps mounted on a train comprising the steps of:

driving a first of said lamps responsive to a first pulse width modulated signal;

driving a second of said lamps responsive to a second pulse width modulated signal;

producing said first and second pulse width modulated signals by varying the duty cycle of said first and second pulse width modulated signals between high and low levels to alternatively turn said first and second lamps approximately fully on and approximately fully off; and sensing when said first and second lamps, respectively, are in one of open and shorted conditions.

20. The method according to claim 19 further comprising the step of indicating a fault condition when said open and shorted conditions of said first and second lamps occur with the aid of at least one fault indicator.

21. The method according to claim 19 further comprising the steps of attempting recovery of said first and second lamps, respectively, after a predefined interval after said sensing step has sensed one of said open and short conditions of said first and second lamps, respectively.

22. The method according to claim 21 further comprising the step of sensing when the temperature of said first and second lamps exceeds a temperature threshold, wherein said attempting recovery step is not carrying out if said sensing step senses said temperature exceeding said temperature threshold.

23. The method according to claim 16 wherein said low level of the duty cycle of said first and second pulse width modulated signals is about 2%, and said high level of the duty cycle of said first and second pulse width modulated signals is between about 15% to about 100%.

24. A visual warning system for a railway vehicle comprising:

a lamp;

a lamp driver for driving said lamp responsive to a signal; and a controller for producing said signal in which the duty cycle of said signal is varied between high and low levels to alternatively turn said lamp approximately fully on and approximately fully off, wherein said controller to turn approximately fully on said lamp increases said duty cycle of said signal step-wise from said low level to said high level.

25. A visual warning system for a railway vehicle comprising:

a first lamp and second lamp;

a first lamp driver for driving said first lamp responsive to a first pulse width modulated signal;

a second lamp driver for driving said second lamp responsible to a second pulse width modulated signal;

a controller for producing said first and second pulse width modulated signals in which the duty cycle of said first and second pulse width modulated signals is varied between high and low levels to alternatively turn said first and second lamps approximately fully on and approximately fully off; and said first and second lamp drivers each further comprise means responsive to said controller for preheating their respective first and second lamps for a predefined interval before said first and second lamps are first alternately turned approximately fully on and approximately fully off.

26. A method of illuminating railway track with a pair of lamps mounted on a train comprising the steps of:

driving a first of said lamps responsive to a first pulse width modulated signal;

driving a first of said lamps responsive to a second pulse width modulated signal;

producing said first and second pulse width modulated signals by varying the duty cycle of said first and second pulse width modulated signals between high and low levels to alternatively turn said first and second lamps approximately fully on and approximately fully off; and preheating said first and second lamps for a predefined interval before said producing step is carried out.

* * * * *